US009987190B2

(12) United States Patent
Stout

(10) Patent No.: US 9,987,190 B2
(45) Date of Patent: Jun. 5, 2018

(54) SHARED CYBERNETICS USING GESTURES

(71) Applicant: Kelsey MacKenzie Stout, Bakersfield, CA (US)

(72) Inventor: Kelsey MacKenzie Stout, Bakersfield, CA (US)

( * ) Notice: Subject to any disclaimer, the term of this patent is extended or adjusted under 35 U.S.C. 154(b) by 977 days.

(21) Appl. No.: 14/283,202

(22) Filed: May 20, 2014

(65) Prior Publication Data

US 2014/0350333 A1 Nov. 27, 2014

Related U.S. Application Data

(63) Continuation-in-part of application No. 13/040,279, filed on Mar. 4, 2011, now Pat. No. 9,295,572.

(51) Int. Cl.
*A61H 19/00* (2006.01)
*A61H 23/02* (2006.01)

(52) U.S. Cl.
CPC ..... *A61H 19/44* (2013.01); *A61H 19/34* (2013.01); *A61H 23/0263* (2013.01); *A61H 2201/5002* (2013.01); *A61H 2201/5023* (2013.01); *A61H 2201/5061* (2013.01)

(58) Field of Classification Search
CPC ..... A61F 2/26; A61H 19/44; A61H 19/50; A61B 17/43
USPC ..... 600/38–41, 898
See application file for complete search history.

(56) References Cited

U.S. PATENT DOCUMENTS

| | | | | |
|---|---|---|---|---|
| 7,513,868 | B1 * | 4/2009 | Fontenot | A61H 19/44 600/38 |
| 2004/0082831 | A1 * | 4/2004 | Kobashikawa | A61H 19/34 600/38 |
| 2009/0093673 | A1 | 4/2009 | Lee | |
| 2009/0171144 | A1 * | 7/2009 | Squicciarini | A61F 2/26 600/38 |
| 2009/0270674 | A1 * | 10/2009 | Trzecieski | A61H 19/44 600/38 |
| 2010/0268021 | A1 | 10/2010 | Standfest | |

OTHER PUBLICATIONS

Sato M., Poupyrev I., and Harrison C., Touché: "Enhancing Touch Interaction on Humans, Screens, Liquids, and Everyday Objects", presented at the ACM SIGCHI Conference on Human Factors in Computing Systems, May 5, 2012, Austin TX, USA.

* cited by examiner

*Primary Examiner* — Samuel Gilbert

(57) ABSTRACT

A vibrator sex toy is provided with touch-based sensors for an ergonomic in-situ method of controlling the operation and intensity of the vibrator. The vibrator sex toy has an internal end, an external end and a middle staging section. The staging section includes a control circuit and batteries. The internal end includes electric vibrator motors connected to the control circuit by wires.

The external end includes ergonomically placed touch sensors that behave like variable resistors. The touch sensors respond to natural human gestures such as grasping, stretching, compressing and bending the external end of the sex toy with changes in resistance. The touch sensors are connected to the control circuit by wires and act as potentiometers in the control path of the vibrator motors. The user is able to vary the sensations from the motors intuitively and in-situ by manipulating the external end or applying it to a partner.

20 Claims, 26 Drawing Sheets

FLOW CHART FOR CYBERNETIC VIBRATOR WITH IN-SITU GESTURE CONTROLS

| gesture | fwd motor amp. ratio | fwd motor per. ratio | rear motor amp. ratio | rear motor per. ratio | motor pan amp. | motor pan per. | overall amp. | overall per. |
|---|---|---|---|---|---|---|---|---|
| bend | - | - | - | - | -FWD, +RWD | +FWD, -RWD | - | - |
| straighten | - | - | - | - | +FWD, -RWD | -FWD, +RWD | - | - |
| stretch | - | - | - | - | - | - | -amp. | +per. |
| compress | - | - | - | - | - | - | +amp. | -per. |
| grasp - far | 10/1 | 2/1 | 2/1 | 2/1 | - | - | - | - |
| grasp - near | 2/1 | 2/1 | 10/1 | 2/1 | - | - | - | - |
| hip-press | 6/1 | 4/1 | 8/1 | 3/1 | - | - | - | - |
| clench | 8/1 | 3/1 | 6/1 | 4/1 | - | - | - | - |
| unclench | 2/1 | 4/1 | 2/1 | 4/1 | - | - | - | - |

Fig. 20

| gesture | fwd motor amp. ratio | fwd motor per. ratio | rear motor amp. ratio | rear motor per. ratio | drag | bend | straighten |
|---|---|---|---|---|---|---|---|
| encircle far | 8/1 | 1/2 | 4/1 | 1/2 | - | +amp, -spd | -amp, +spd |
| encircle drag toward | 8/1 | 1/2 | 4/1 | 1/2 | motor pan spd+amp RWD | - | - |
| encircle near | 4/1 | 1/1 | 8/1 | 1/1 | - | +amp, -spd | -amp, +spd |
| encircle drag away | 4/1 | 1/1 | 8/1 | 1/1 | motor pan spd+amp FWD | - | - |
| dbl. encircle far | 10/1 | 2/1 | 2/1 | 2/1 | - | -amp, +spd | +amp, -spd |
| dbl. encircle drag toward | 10/1 | 2/1 | 2/1 | 2/1 | Motor amp. pan RWD | - | - |
| split encircle | 6/1 | 3/1 | 6/1 | 3/1 | - | Motor pan amplitude | Motor pan amplitude |
| split encircle drag toward | 6/1 | 3/1 | 6/1 | 3/1 | motor spd pan RWD | - | - |
| dbl. encircle near | 2/1 | 4/1 | 10/1 | 4/1 | - | -amp, +spd | +amp, -spd |
| dbl. encircle drag away | 2/1 | 4/1 | 10/1 | 4/1 | motor amp. pan FWD | - | - |
| split encircle drag away | 6/1 | 3/1 | 6/1 | 3/1 | motor spd pan FWD | - | - |
| no gesture | 1.5/1 | 1/1 | 1.5/1 | 1/1 | - | - | - |

Fig. 39

SHARED CYBERNETICS USING GESTURES

CROSS-REFERENCE TO RELATED APPLICATION

This application is a continuation-in-part of, and claims priority under 35 U.S.C. § 120 from, nonprovisional U.S. patent application Ser. No. 13/040,279 entitled "Cybernetic Vibrator With Sensors For Natural Gesture Controls," filed on Mar. 4, 2011, the subject matter of which is incorporated herein by reference. application Ser. No. 13/040,279, in turn, claims priority under 35 U.S.C. § 119(e) from U.S. Provisional Patent Application No. 61/310,687, entitled "Cybernetic Vibrator With Sensors For Natural Gesture Controls", filed Mar. 4, 2010, which is incorporated by reference for all purposes.

TECHNICAL FIELD

The present invention relates generally to sex toys. More particularly, the present invention relates to a sex toy with in-situ hands-free controls.

BACKGROUND INFORMATION

Vibrating sex toys, also known as "vibrators", are typically equipped with fader-style controls that allow a user to vary the intensity of an electric vibrator motor, thereby altering the sensations produced by the toy. Unfortunately, fader-type controls in a vibrator sex toy are not optimal because they are distractions from the very sensations they control. A more natural and ergonomic method of controlling a vibrator sex toy in-situ is sought.

Additionally, a sex toy is often employed by a user in conjunction with a partner. The user may apply the sex toy with a phallic or other shape to the partner. One form of such a sex toy that is employed with a partner is the "double-ended dildo", which allows a female user to mimic having a phallus to apply to a partner. Such a double-ended dildo may include vibrating motors, but, again, a fader-type control is often not useable with this form of sex toy. A fader-type control in a double-ended dildo form of sex toy is awkward and distracts from the ability to mimic having a phallus. A method of controlling this form of vibrator sex toy that simultaneously employs input by both the user and the user's partner by a user is sought.

SUMMARY

A vibrator sex toy is provided with touch-based sensors for an ergonomic method of controlling the operation and intensity of the vibrator using natural gestures. The vibrator sex toy has at least an internal end and an external end, and usually a middle staging section. The internal end and external end are each substantially phallic in shape and each comprise a lengthwise axis. Each lengthwise axis comprises a proximal end and a distal end, with the proximal end of each axis pointed towards the point at which the internal end and the external end meet, or toward the staging section.

The staging section includes an control circuit and batteries. The internal end includes electric vibrator motors connected to the control circuit by wires. The external end includes ergonomically placed touch sensors that behave like variable resistors. In embodiments where a staging section is not used, the control circuit and battery may instead be in either end The described internal end, external end and staging section are portions of a silicone housing, with electrical components deployed between layers of silicone. Alternatively, the electrical components may be deployed in the interior of a hollow silicone housing. The housing may also be constructed of materials other than silicone.

The touch sensors may be of known types, such as pressure sensors, bend sensors, stretch sensors, compression sensors, temperature sensors, humidity sensors, galvanic skin sensors, photoresistors, accelerometers or other types of sensors. Electrode sensors that sense changes in return amplitude across a range of frequencies are also described that allow detection of a variety of complex touches by hands or other parts of the body.

Because they are deployed just at or under the surface of the silicone housing, natural human gestures such as grasping, stretching, squeezing and bending the external end of the sex toy activate the embedded sensors. The embedded sensors respond to activation with a change in resistance to current flowing through the sensors via electrical leads. This change in resistance allows the sensors to function as variable resistors in the control path of the one or more vibrator motors.

The touch sensors are connected to the control circuit in the staging section by electrical leads. One or more sensors may be connected in series or in parallel in the control path of a motor such that input from one or more sensors changes the frequency or rhythm of a vibrator motor. Thus, touch and movement by the user and the user's partner dynamically varies the behavior of the vibrator motors in the course of manipulating the external end of the toy or applying it to a partner. Interrupting the use of the toy in order to employ a fader-style control is made unnecessary.

Other methods and structures are described in the detailed description below. This summary does not purport to define the invention. The invention is defined by the claims.

BRIEF DESCRIPTION OF THE DRAWINGS

FIG. 20 is a table illustrating associations between sensor activations and motor responses in an embodiment of the device.

FIG. 39 is a table illustrating associations between sensor activations and motor responses in another embodiment of the device.

DESCRIPTION OF PRIOR ART

Figure 1:
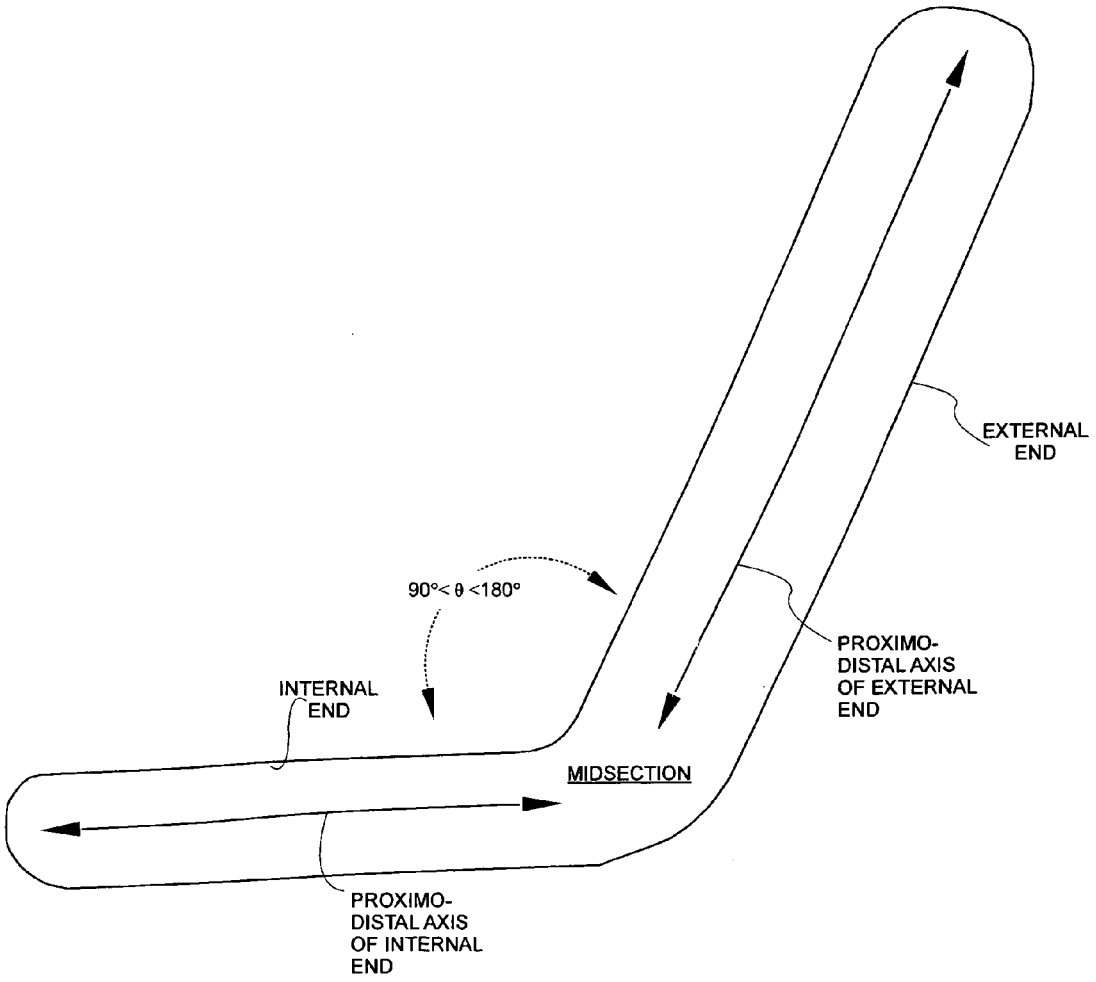
Fig. 1 PRIOR ART
FIG. 1 (Prior Art) is a simplified side view of a double-ended dildo type sex toy as known in the prior art.

FIG. 1 (Prior Art) is a simplified side view of a double-ended dildo type sex toy as known in the prior art. It has two extremities, shown as an Internal End and an External End, with a Midsection where the two extremities meet.

Each of the two extremities is generally phallic in shape, such shape being characterized for commercial purposes as being 100 cm or more in length. Each of the two extremities has a Proximo-Distal Axis, with the proximal end of the axis terminating at the Midsection and the distal end of the axis terminating at the generally rounded end of the extremity. Each extremity is substantially cylindrical with a diameter less than half its length.

Typically, the Internal End is held in place in the vagina of a user of the device. Said Internal End is typically of lesser length than the External End, such that the External End may be easily held in a hand or penetrate a second user. To facilitate such usage, the angle between the dorsal surface of the Internal End and the dorsal surface of the External End is equal to or less than 180° and greater than 20°. FIG. 1 (Prior Art) shows the obtuse angled case, wherein the angle between the extremities is between 90° and 180°.

Figure 2:
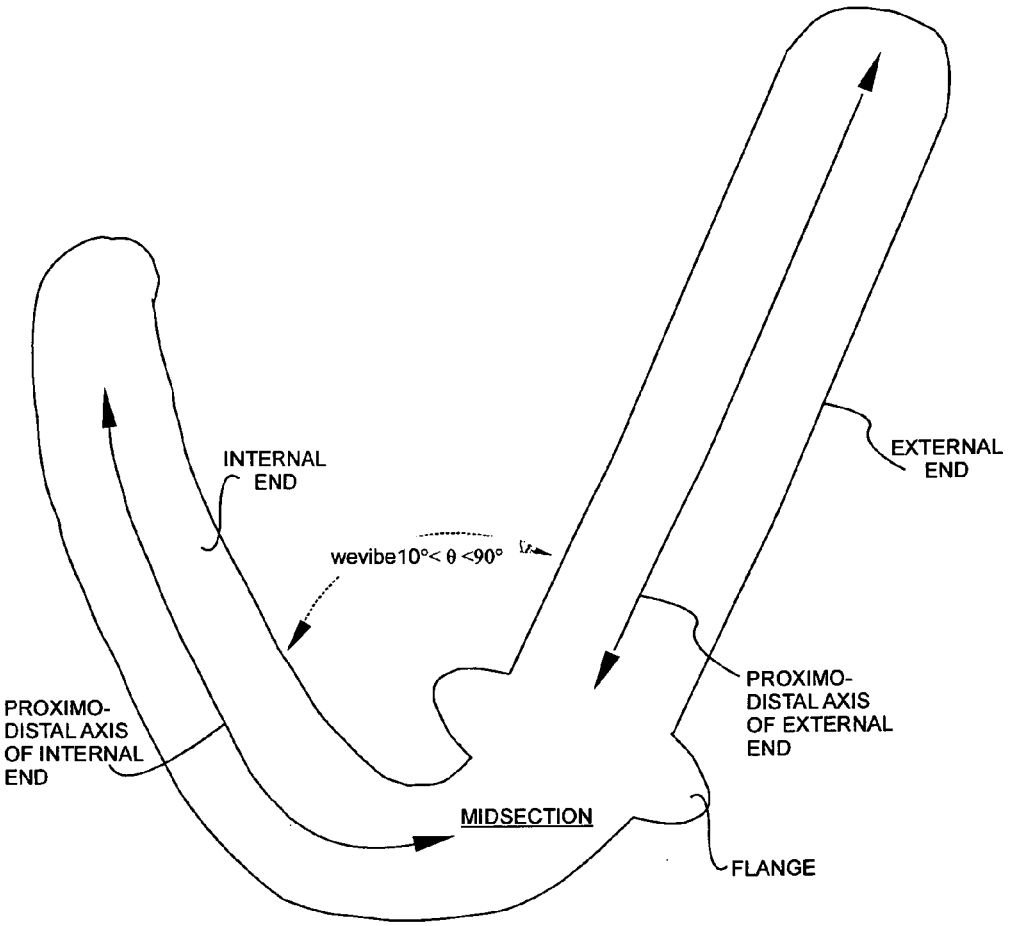
Fig. 2 PRIOR ART
FIG. 2 (Prior Art) is a simplified side view of a double-ended dildo type sex toy showing a variation known in the prior art in which at least one extremity is curved such that the dorsal surface of the extremity has a concave curvature and the ventral surface has a convex curvature.

FIG. 2 (Prior Art) is a simplified side view of a double-ended dildo type sex toy showing a variation known in the prior art wherein at least one extremity is curved such that the dorsal surface of the extrenity has a concave curvature and the ventral surface has a convex curvature. In the illustrated example, the substantially phallic in shape Internal End has such a curvature. The Proximo-Distal Axis of the Internal End is therefore also curved. The Internal End typically has a greater degree of curve than the External End in such devices.

FIG. 2 (Prior Art) also shows the acute angled case, wherein the angle between the extremities is between 20° and 90°. Further, FIG. 2 (Prior Art) illustrates that the Midsection or either extremity may include a Flange portion that facilitates the device being held in using a harness worn by a user.

Figure 3:
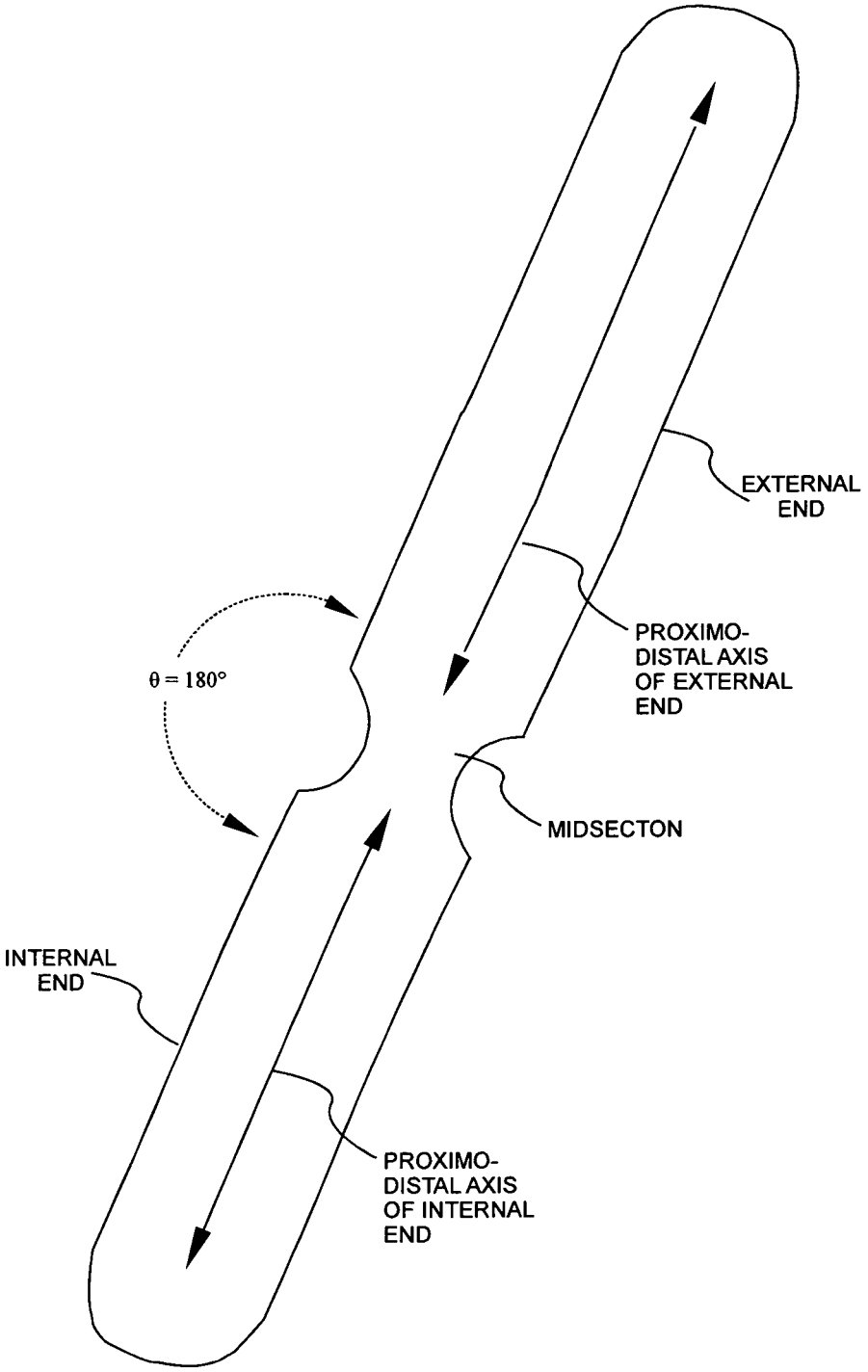
Fig. 3 PRIOR ART
FIG. 3 (Prior Art) illustrates the case wherein the angle between the extremities is 180°.

FIG. 3 (Prior Art) illustrates the case wherein the angle between the extremities is 180°. Further, FIG. 3 (Prior Art) illustrates that the Midsection or either extremity may include an indented area that facilitates the device being held in using a harness worn by a user.

DETAILED DESCRIPTION OF INVENTION

Figure 4:
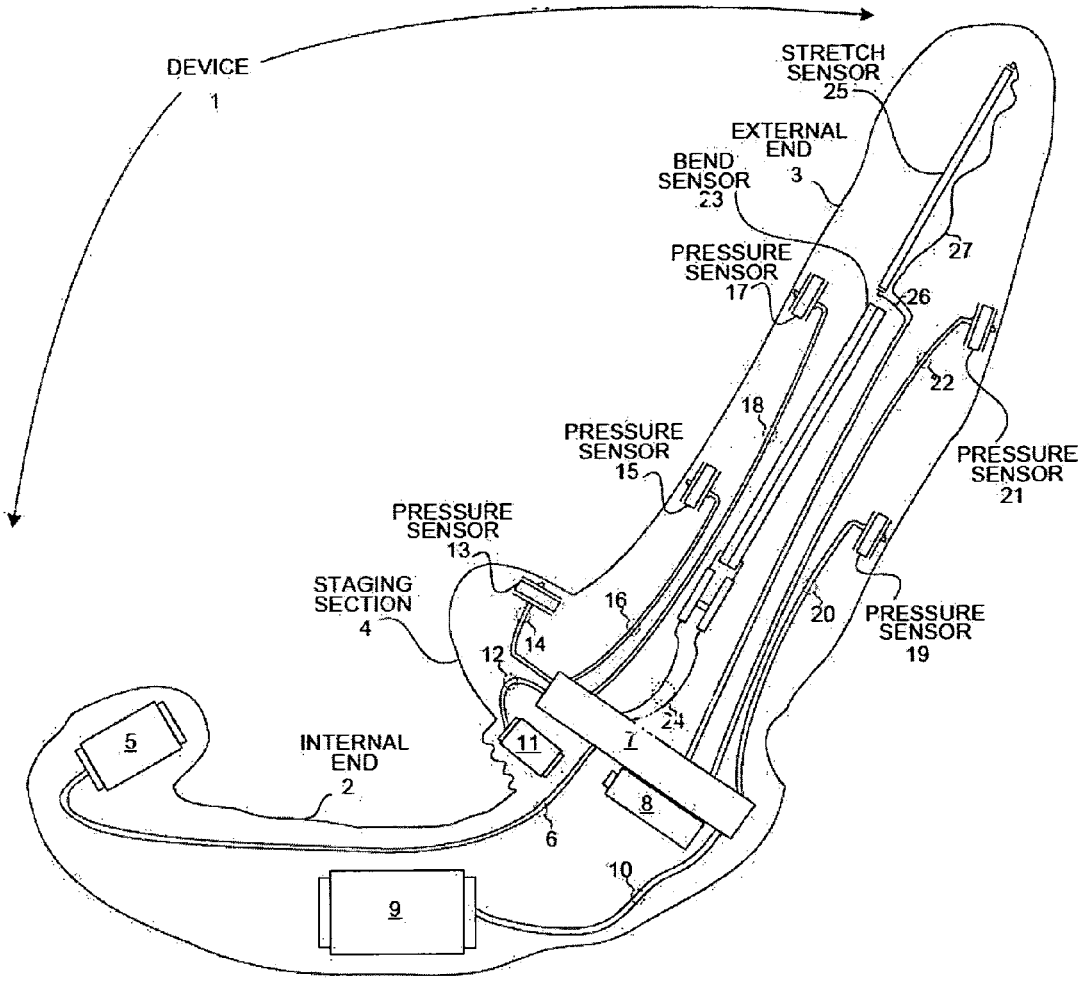
FIG. 4 is a side view of an embodiment of a cybernetic vibrator device with ergonomic sensor-based controls, in accordance with one novel aspect.

FIG. 4 is a side view of an example cybernetic vibrator device 1 with ergonomic sensor-based controls, in accordance with one novel aspect. The device 1 is made of silicone, or other flexible material such as "Cyberskin". The material of the device 1 is flexible, such that bend and stretch sensors embedded in the materials can be flexed or stretched or compressed. The material of the device 1 also ideally allows embedding of compression sensors near the surface of the material.

The flexible material of the device 1 embodies aspects of the double-ended device described above in regard to FIG. 1, FIG. 2 and FIG. 3. It has two extremities, shown as an internal end 2 and an external end 3, with a midsection where the proximo-distal axis of each extremity terminates. In the invention, the midsection is referred to as the staging section 4.

Each of the two extremities is generally phallic in shape and greater than 100 cm in length. Each extremity is substantially cylindrical with a diameter less than 50 cm. The angle between the dorsal surface of the internal end 2 and the dorsal surface of the external end 3 is equal to or less than 180° and greater than 20°. The staging section 4, illustrated as having a diameter bulging to greater than that of external end 3, facilitates wearing of the device using a support harness. Other embodiments may have simpler cylindrical shapes without such a bulge in the middle section.

In the illustrated example, the internal end 2 includes a first electric vibrator motor 5 connected by a pair of electrical leads 6 to a control circuit 7 housed in the staging section 4. A second example vibrator motor 9 connected to the control circuit 7 by a pair of electrical leads 10 is also pictured. Note that, in other embodiments, the example motors may perform functions other than vibration, such as altering the shape of the silicone body of the device 1. Motors in this example are voltage controlled motors.

A third example vibrator motor 11 is housed in the staging section 4 of the device 1 and connected to the control circuit 7 by a pair of electrical leads 12. The control circuit 7 in the staging section 4 is powered by one or more batteries 8. The control circuit 4 supplies power to the example motors 5 9 and 11 and controls the voltages of the power supplied to each motor.

Staging Section

Housed in the staging section 4 near the surface of the silicone material is a first fore sensor 13, such as a force sensing resistor. The first force sensor 13 is connected with the control circuit by a pair of electrical leads 14. Note that such a sensor may also have a third (ground) lead, which is not illustrated. Via its pair of electrical leads 14, the first force sensor 13 forms part of the control path of an example vibrating motor. In the illustrated example, the first force sensor 13 is in the control path of the first electric vibrator motor 5.

The resistance to current flowing through first force sensor 13 via leads 14 changes when force is applied to the sensor 13. Thus, when pressure is applied to the surface of the staging section 4 near the sensor 13, resistance in the control circuit for first electric vibrator motor 5 is altered. The resistance change in the control circuit produces a sensor output control signal, such as a change in voltage, that controls the speed of electric vibrator motor 5. Because the internal end 2 of the device 1 is worn inserted into the vagina with the staging section 4 forward of the pubic bone, pressure can be applied to first force sensor 13 by pressing the hips forward against a partner or hard surface rather than by a hand.

First electric vibrator motor 5 thus vibrates at varying speeds in response to ergonomic input by the user or user's partner. Such ergonomic input that obviates the need to employ traditional fader, dial or button controls will be referred to herein as in-situ gestures. In-situ gestures include actions taken by the user or by the user's partner in the course of using a device that can have a purpose beyond or in addition to the purpose of controlling the electrical elements of the device. As examples, users of the device may wish to change the location, shape, camber, angle of attack of the device, or change their grip on the device. In doing so, users will perform in-situ gestures such as bending, grasping, squeezing, moving, and shaking the device, as well as swiping a finger along the surface of an extremity of of the device, stretching an extremity of the device longitudinally, and compressing an extremity of the device longitudinally. Thus, natural motions and gestures by users in the course of using the device control the vibrations produced.

In-situ gestures do not have to be performed by hand. A user could perform an in-situ gesture by applying pressure to the device using, for instance, the pelvis. In-situ gestures here are contrasted with and do not include controlling a device by manipulating a traditional electrical control such as a fader, slider, dial, button or switch.

More particularly, touches, gestures and patterns of touches and gestures associated with handling and use of a double-ended sex toy irrespective of any included electronic elements will be referred to as shared toy gestures. Pressing the device against a partner, bending, grasping, squeezing, or shaking an extremity of the device, and stroking, stretching or compressing an extremity of of the device longitudinally are categorized, in the context of this disclosure as shared toy gestures where the device includes two extremities, each extremity having a proximo-distal axis, with the proximal end of the axis terminating at a midsection of the device and the distal end of the axis terminating at the generally rounded end of the extremity. Shared toy gestures can be considered a sub-set of in-situ gestures.

Dorsal Surface

Second force sensor 15 is similarly housed in the external end 3 near the dorsal surface of the silicone material. The second force sensor 15 is connected with the control circuit by a pair of electrical leads 16. Via its pair of electrical leads 16, the second force sensor 15 forms part of the control path of an example vibrating motor.

In the illustrated example, the second force sensor 15 is in the control path of the second electric vibrator motor 9 and pressure on the external end 3 of the device near second force sensor 15 affects the voltage supplied to second electric vibrator motor 9. Second electric vibrator motor 9 thus vibrates at varying speeds due to varying pressures on the external end 3 of the device caused by sexual activity without the need for manual input by the user or the user's partner.

Third force sensor 17 is also housed in the external end 3 near the dorsal surface of the silicone material. The third force sensor 17 is connected with the control circuit by a pair of electrical leads 18. Via its pair of electrical leads 18, the third force sensor 17 forms part of the control path of an example vibrating motor.

In the illustrated example, the third force sensor 17 is in the control path of the second electric vibrator motor 9. Third force sensor 17 may be disposed in series or in parallel with second force sensor 15 in this example. Pressure on the external end 3 of the device 1 near third force sensor 17 affects the voltage supplied to second electric vibrator motor 9. Second electric vibrator motor 9 thus vibrates at varying speeds due to varying pressures on the external end 3 of the device caused by sexual activity without the need for manual input by the user or the user's partner.

Ventral Surface

Fourth force sensor 19 is housed in the external end 3 near the ventral surface of the silicone material. The fourth force sensor 19 is connected with the control circuit by a pair of electrical leads 20. Via its pair of electrical leads 20, the fourth force sensor 19 forms part of the control path of an example vibrating motor.

In the illustrated example, the fourth force sensor 19 is in the control path of the third electric vibrator motor 11 and pressure on the external end 3 of the device near fourth force sensor 19 affects the voltage supplied to third electric vibrator motor 11. Third electric vibrator motor 11 thus vibrates at varying speeds due to varying pressures on the external end 3 of the device caused by sexual activity without the need for manual input by the user or the user's partner.

Fifth force sensor 21 is also housed in the external end 3 near the ventral surface of the silicone material. The fifth force sensor 21 is connected with the control circuit by a pair of electrical leads 22. Via its pair of electrical leads 22, the fifth force sensor 21 forms part of the control path of an example vibrating motor.

In the illustrated example, the fifth force sensor 21 is in the control path of the third electric vibrator motor 11. Fifth force sensor 21 may be disposed in series or in parallel with fourth force sensor 19 in this example. Pressure on the external end 3 of the device 1 near fifth force sensor 21 affects the voltage supplied to second electric vibrator motor 11. Third electric vibrator motor 11 thus vibrates at varying speeds due to varying pressures on the external end 3 of the device caused, generally, by in-situ gestures, and more particularly by shared toy gestures, during sexual activity without interrupting activity to operate traditional manual controls.

Bend Sensors

An example bend sensor 23 is disposed longitudinally within the external end 3. The bend sensor 23 is connected with the control circuit by a pair of electrical leads 24. Via its pair of electrical leads 24, the bend sensor 23 forms part of the control path of an example vibrating motor. In the illustrated example, the first force sensor 13 is in the control path of the first electric vibrator motor 5.

The resistance to current flowing through bend sensor 23 via leads 24 changes when force is applied to the bend sensor 23. Thus, when external end 3 is bent upwards or downwards, resistance in the control circuit for first electric vibrator motor 5 is altered such that the voltage supplied to first electric vibrator motor 5 is also altered. Because the external end 3 of the device 1 is flexible and undergoes constant changes in bend angle due to sexual activity, first electric vibrator motor 5 vibrates at varying speeds in response to the motion of the user or the user's partner without the need for manual input.

Strain Sensor

An example strain sensor 25 (also known as a stretch sensor) is disposed longitudinally within the external end 3. the strain sensor 25 is connected with the control circuit by a pair of electrical leads 26 and 27. Via its pair of electrical leads 26 and 27, the strain sensor 25 forms part of the control path of an example vibrating motor. In the illustrated example, the strain sensor 25 is in the control path of the third electric vibrator motor 11.

The resistance to current flowing through strain sensor 25 via leads 26 and 27 changes when the strain sensor 23 is stretched or compressed longitudinally. Thus, when external end 3 is stretched or compressed longitudinally, resistance in the control circuit for third electric vibrator motor 11 is altered such that the voltage supplied to third electric vibrator motor 11 is also altered. Because the external end 3 of the device 1 is flexible and undergoes stretching and longitudinal compression due to sexual activity, third electric vibrator motor 11 vibrates at varying speeds in response to the in-situ gestures of the user or the user's partner without the need for manual input.

Reversed Embodiment

Figure 5:
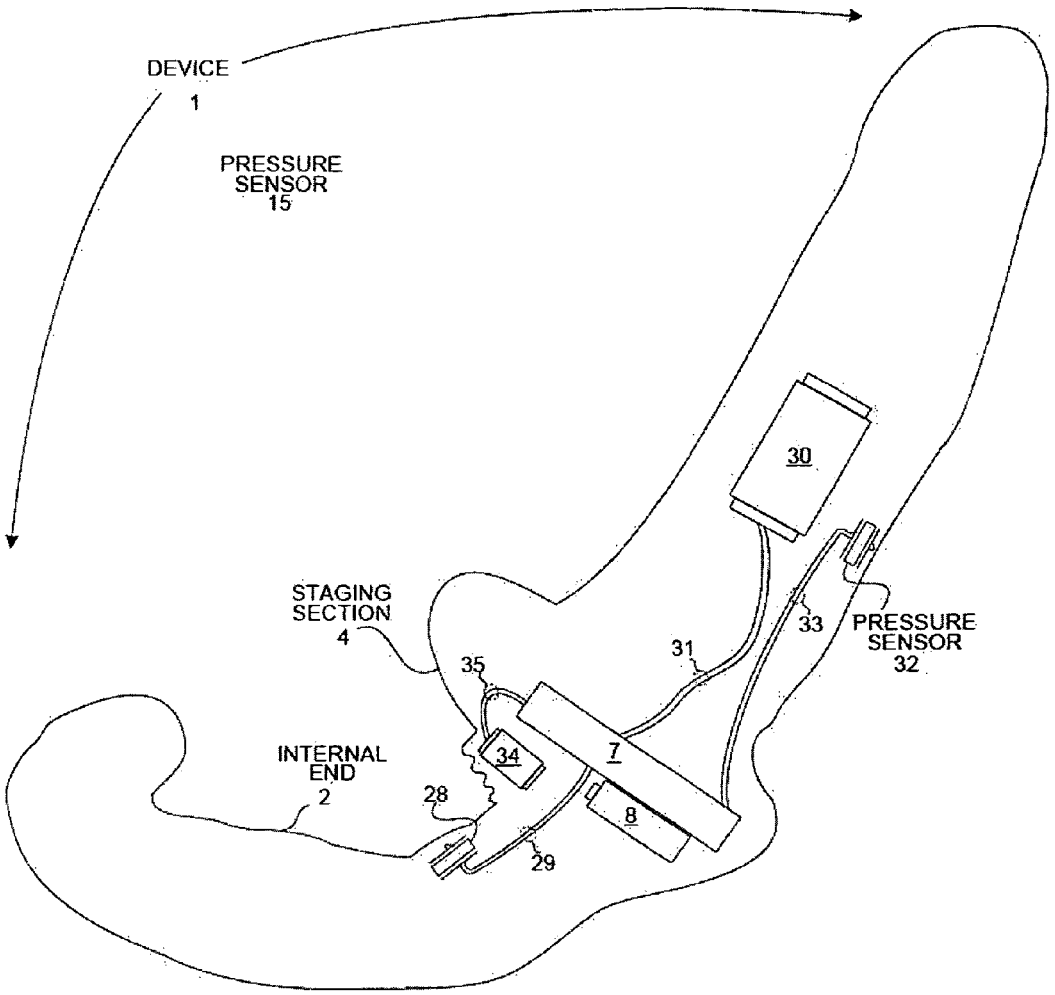
FIG. 5 is a side view of a second embodiment of a cybernetic vibrator device with reversed ergonomic sensor-based controls, in accordance with another novel aspect.

FIG. 5 is a side view of a second embodiment of a cybernetic vibrator device with reversed ergonomic sensor-based controls, in accordance with another novel aspect. In FIG. 5, touch sensors and their associated motors are disposed in either end of the device 1, such that the user and the user's partner may have simultaneous affects on touch sensors, each effectively controlling a vibrator motor sensed by the other.

Device 1 includes an internal end 2, and external end 3 and a (middle) staging section 3. The internal end 2 in the example drawing is shaped to conform to a woman's genitalia, but may have another shape. In the illustrated example, the internal end 2 includes a first force sensor 28 connected by a pair of electrical leads 29 to a control circuit 7 housed in the staging section 4.

A first example vibrator motor 30 is housed in the external end 3 of the device 1 and connected to the control circuit 7 by a pair of electrical leads 31. The control circuit 7 in the staging section 4 is powered by one or more batteries 8. The control circuit 4 supplies power to the example motors 30 and 34 and controls the voltages of the power supplied to each motor.

Via its pair of electrical leads 29, the first force sensor 28 forms part of the control path of first electric vibrator motor 5. Because the first force sensor 28 is located within the portion of device 1 which is disposed within the vagina of the user, muscular contractions of the vagina can be used to control first electric vibrator motor 5. Thus, sensations perceived by the user's partner vary in response to the natural motion of the user without the need for manual input.

A second force sensor 32 disposed within the external end 3 of the device 1 similarly controls a second example vibrator motor 34. Second vibrator motor 34 is disposed such that its vibrations are perceived by the user, and second force sensor 32 is disposed such that it is activated by natural gestures by the user's partner, as is explained above in regard to FIG. 1.

Note that various other arrangements of sensors and sensor-controlled devices can be made. The sensors may be of known types such as pressure sensors, bend sensors, stretch sensors, strain sensors, compression sensors, temperature sensors, humidity sensors, galvanic skin sensors, photoresistors, capacitive touch sensors, resistive touch sensors, accelerometers or other types of sensors. A stretch sensor, bend sensor, or other type of sensor can be disposed in the internal end 2 of the device 1 for activation by muscle contractions. Internal sensors can be connected so as to control internal vibrator motors, and external sensors can be connected so as to control external vibrator motors. Devices other than vibrator motors, such as actuators and LED lights, can also be controlled using the described methods. A microprocessor and memory can be employed to produce device or motor input control signals in response to various combinations or patterns of gestures applied to the various sensors.

Example Circuit

Figure 6:
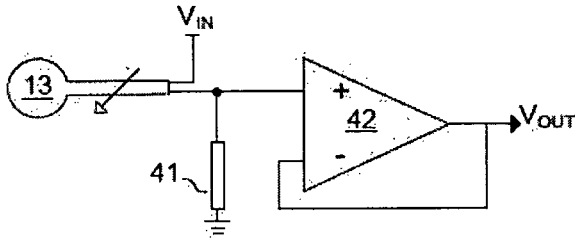
FIG. 6 is an example circuit diagram showing a force sensor 13 in the control path of a DC vibrator motor 5.

FIG. 6 is an example circuit diagram showing a force sensor 13 in the control path of a DC vibrator motor 5. Force sensor 13 is a force sensitive resistor (FSR) with, in this example, a resistance at rest of 10,000 ohms. FSR 13 is disposed in a voltage divider arrangement with a second resistor 41 which also has a resistance of 10,000 ohms. Pressure is applied to the FSR 13 when the user of the device or user's partner grasps, pulls or squeezes the device 1 housing surface near where the FSR 13 is situated.

As increasing pressure from the grasping gesture is translated through the flexible surface of the device 1 to the force sensitive portion of the FSR 13 (indicated by the rounded portion of item 13 in FIG. 6), the resistance of FSR 13 decreases from its maximum of 10,000 ohms. This allows an increased level of $V_{IN}$ to reach the op-amp 42 via the voltage divider formed by FSR 13 and resistor 41. The output of the op-amp 42 can be output to a microprocessor for voltage polling, or output to a pulse width modulation (PWM) chip for driving the motor 5 via a MOSFET.

Figure 7:
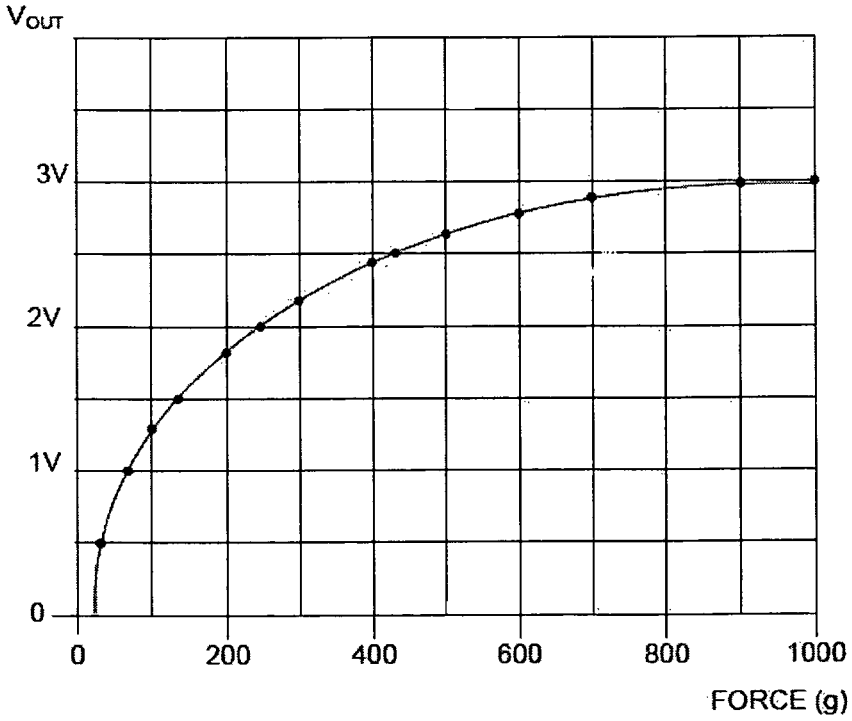
FIG. 7 is a graph showing the voltage curve through a touch sensor as touch pressure is changed.

In this example, $V_{IN}$ is three volts provided by a pair of 1.5 volt batteries 8. The resistance of example FSR 13 drops to near zero at a force of one kilogram. FIG. 7 is a graph showing the voltage curve through the voltage divider as pressure is changed. Note that this curve will be affected by the placement of the sensor and the material used for the device 1 housing. Fine tuning of the voltage curve can be done by selecting a different resistance for the second resistor 41.

Figure 8:
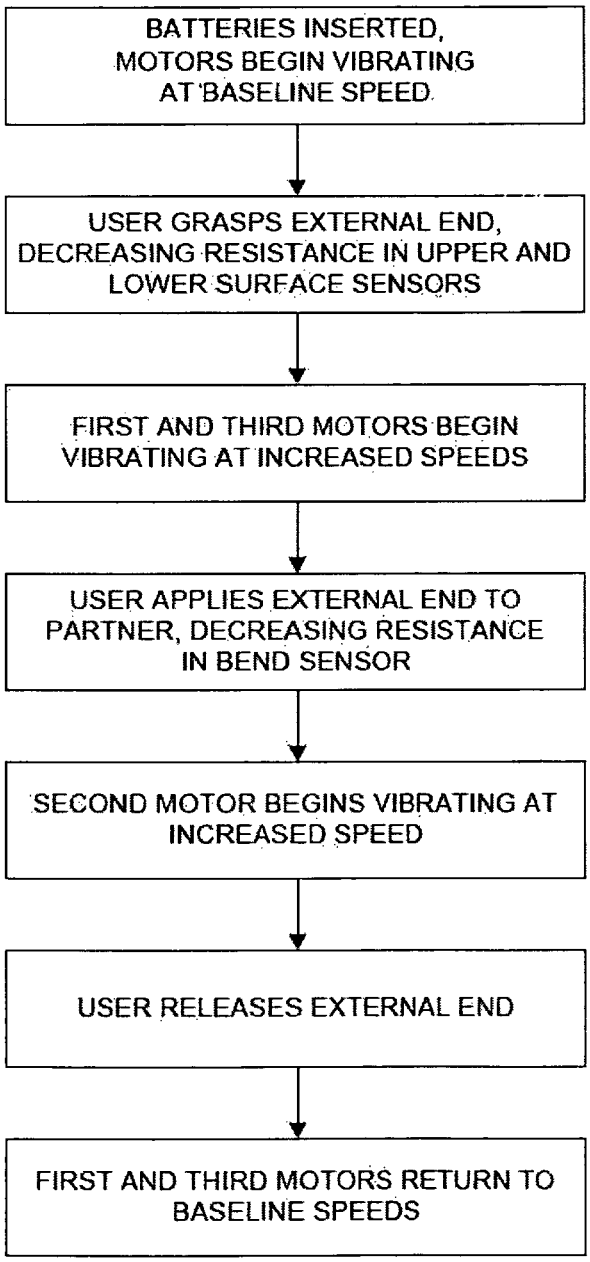
FIG. 8 is a flowchart showing the changes in actuated motor operation in accordance with natural gestures by the user and user's partner.

FIG. 8 is a flowchart showing the changes in actuated motor operation in accordance some example natural gestures by the user and user's partner.

Note that though the touch sensors in the above examples can be thought of as rheostats for controlling the voltage of power supplied to DC motors, other embodiments may employ the touch sensors as motor controls using different methods. Characteristics of the sensors other than changes in resistance, such as instant voltages, may be used. Touch sensors may be in the control path of a DC motor that is controlled via pulse-width modulation (PWM). In another embodiment, the device may employ a microprocessor that polls the electrical characteristics of touch sensors and in response controls DC motors according to programmed responses. Such an embodiment employing a microprocessor may also include a digital interface, such as a USB port, located in the staging section 4. A user could employ the digital interface to modify the programmed responses of the microprocessor.

Note also that the depicted shape of the device is not the only possible shape. The device may, for example, take a traditional cylindrical shape. The housing may be made entirely or only partially of flexible material.

Motor Patterns

A sex toy device that uses a fader or other type of control or sensor typically controls the amplitude of a motor in a relationship that is directly or linearly proportional to the controller setting. In contrast, it is explained here that motors may be controlled in more complex ways.

Motors can be actuated in pulses and patterns of pulses. In a pulse, a motor is actuated to a high amplitude, such as via PWM, for a period of time known as a peak period. A series of such pulses may be strung together to form a pattern. In between each pulse is a trough, wherein the motor runs at a lower amplitude, called a trough amplitude, for a period of time called a trough period.

A motor pattern is thus characterised by two factors. The first factor characterising a motor pattern is a ratio of peak amplitude to trough amplitude, or amplitude ratio. The second factor characterising a motor pattern is a ratio of peak period to trough period, or period ratio. A motor pattern with a high amplitude ratio is considered here to "heavier", in terms of feel, than a motor pattern with a lower amplitude ratio. Similarly, a motor pattern with a high period ratio is considered to be heavier than a motor pattern with a lower period ratio. For the purposes of this disclosure, a heavy motor pattern is one with an amplitude ratio of 6/1 or higher or a period ratio of 3/1 or higher. A motor pattern with an amplitude ratio lower than 6/1 and a period ratio lower than 3/1 is a light motor pattern.

The intensity at which a selected motor pattern with a given amplitude ratio and period ratio is run may be varied by varying the average amplitude or varying the average period. Thus, in the invention, when an in-situ gesture affects a sensor, the result can be a switch to a different motor pattern, or it can be to vary the overall amplitude or apparent speed within a given motor pattern. In the preferred embodiment, motor patterns take the form of square waves, but sine waves could also be used.

Figure 9:
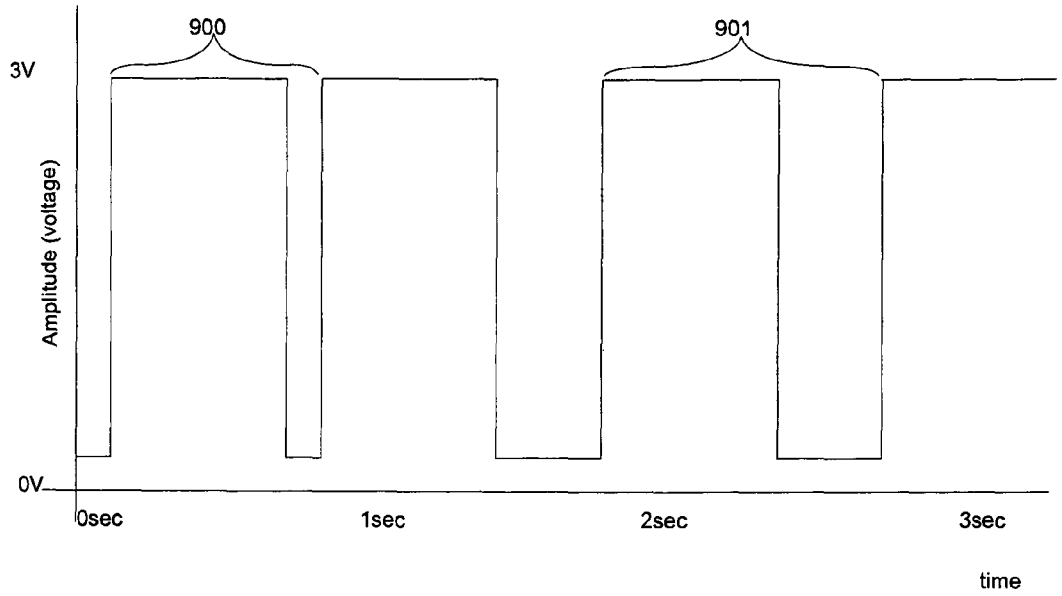
FIG. 9 is a graph illustrating period ratios in motor patterns.
Figure 10:
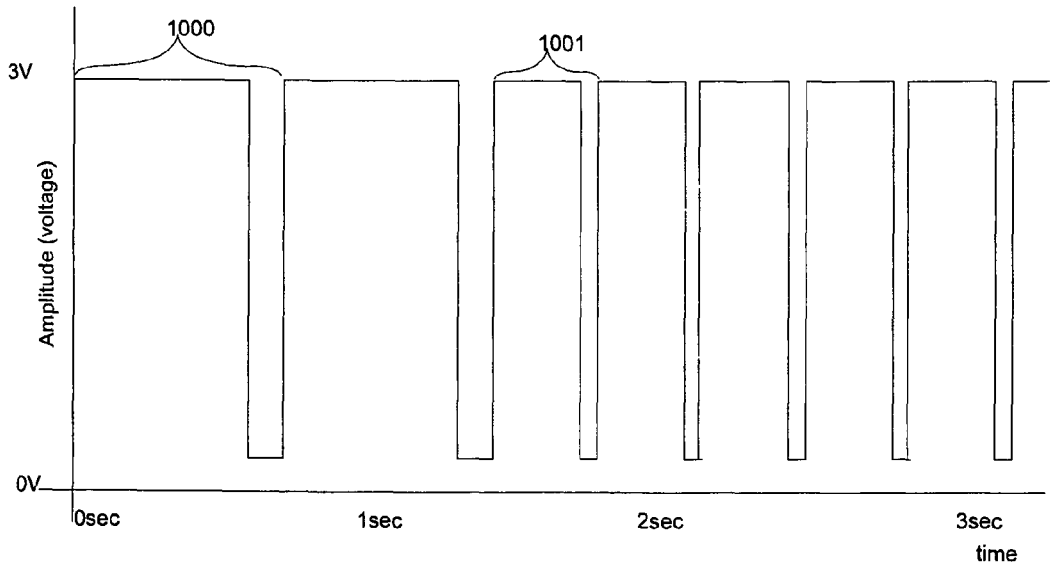
FIG. 10 is a graph illustrating variations in average period within a motor pattern.

FIG. 9, for example, shows the result of sensing an in-situ gesture that causes motors to shift from a motor pattern 900 with a relatively high peak period to trough period ratio and shift to a "lighter" motor pattern 601 characterized by a lower period ratio. FIG. 10, for the sake of comparison, shows the result of sensing an in-situ gesture that causes a motor pattern 1000 characterised by a given period ratio to produce a "speed up" effect, such that in another area of the graph 1001 the average period is reduced so that peaks and troughs occur more quickly—but the motor pattern is not changed.

Figure 11:
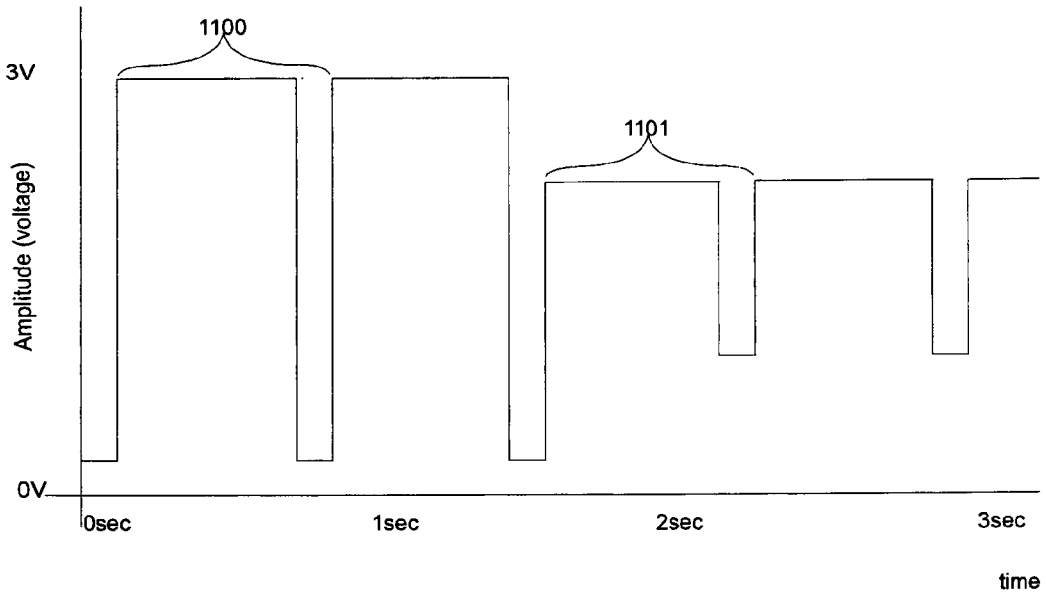
FIG. 11 is a graph illustrating amplitude ratios in motor patterns.
Figure 12:
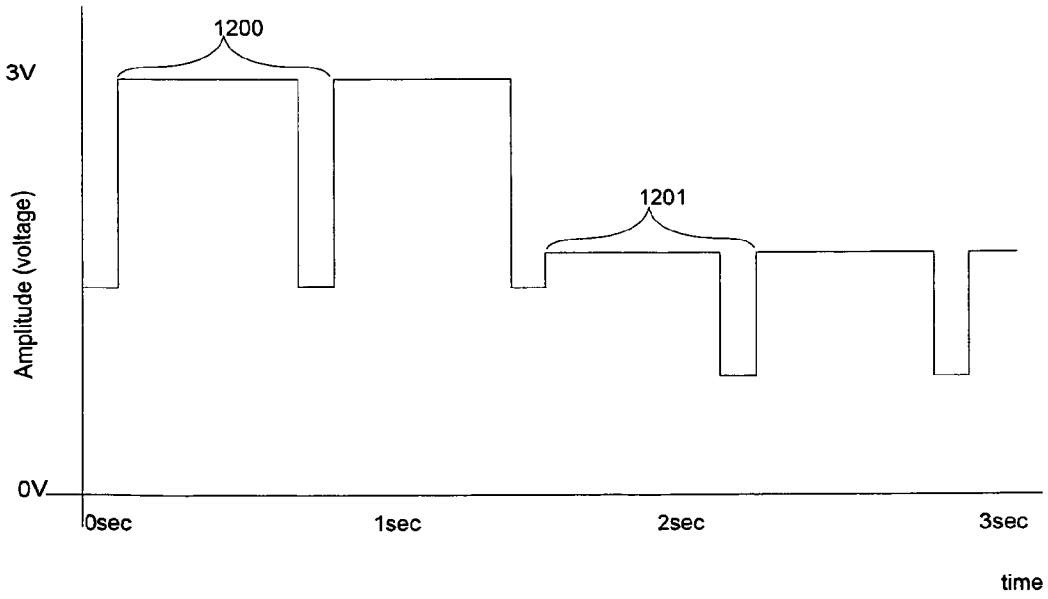
FIG. 12 is a graph illustrating variations in average amplitude within a motor pattern.

FIG. 11 shows the result of sensing an in-situ gesture that causes a change from a motor pattern 1100 with a relatively high peak amplitude to trough amplitude ratio to a less heavy motor pattern 1101 characterized by a smaller amplitude ratio. In this example, the average amplitude does not change. FIG. 12, for the sake of comparison, shows the result of sensing an in-situ gesture that causes a motor pattern 1200 characterised by a given amplitude ratio to diminish, such that in another area on the graph 1201 the average amplitude is reduced but the motor pattern is not changed.

Figure 13:
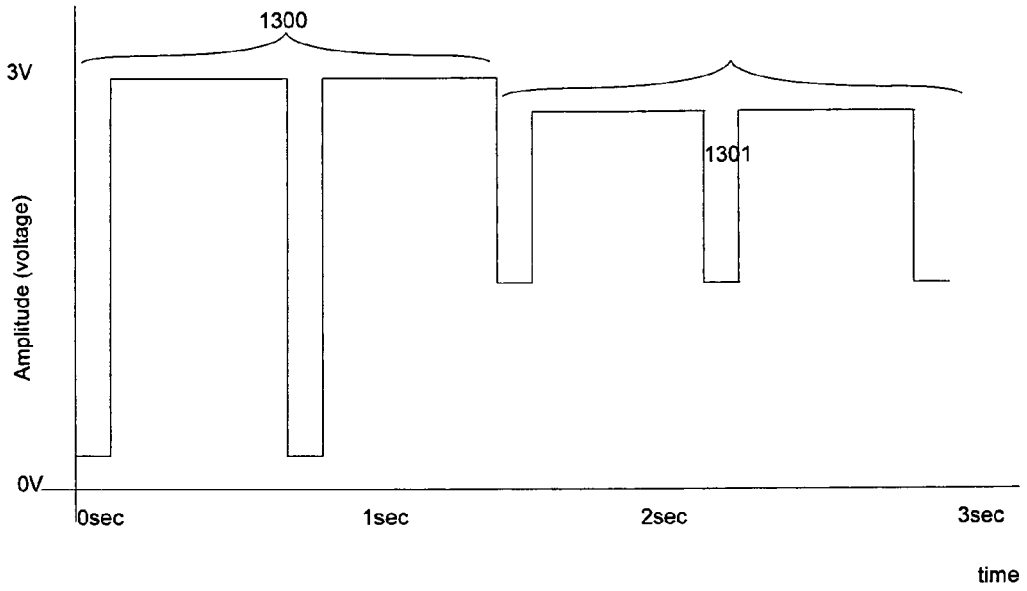
FIG. 13 is a graph illustrating a simultaneous shift in motor pattern and average amplitude.
Figure 14:
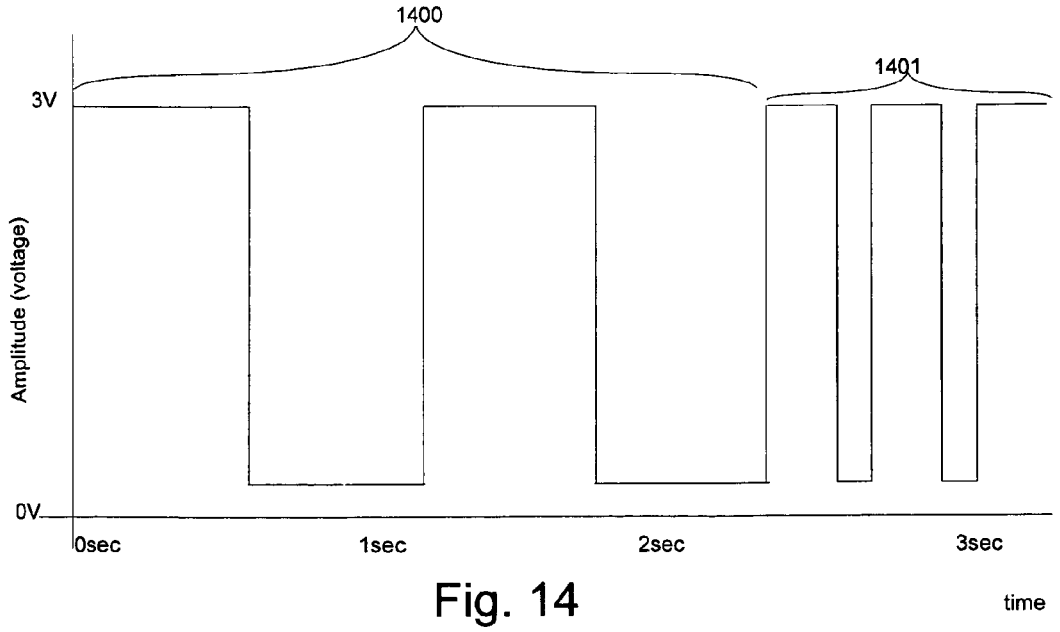
FIG. 14 is a graph illustrating a simultaneous shift in motor pattern and average period.

FIG. 13 shows the result of sensing an in-situ gesture that causes a change from a motor pattern 1300 with a relatively high amplitude ratio to a less heavy motor pattern 1301 characterized by a smaller amplitude ratio but running with an overall higher average amplitude. FIG. 14, for the sake of comparison, shows the result of sensing an in-situ gesture that causes a shift from a motor pattern 1400 characterised by a given period ratio and running at a relatively "slow" average period to a different motor pattern 1401 with a higher period ratio that is also running at a different, "faster" speed.

Figure 15:
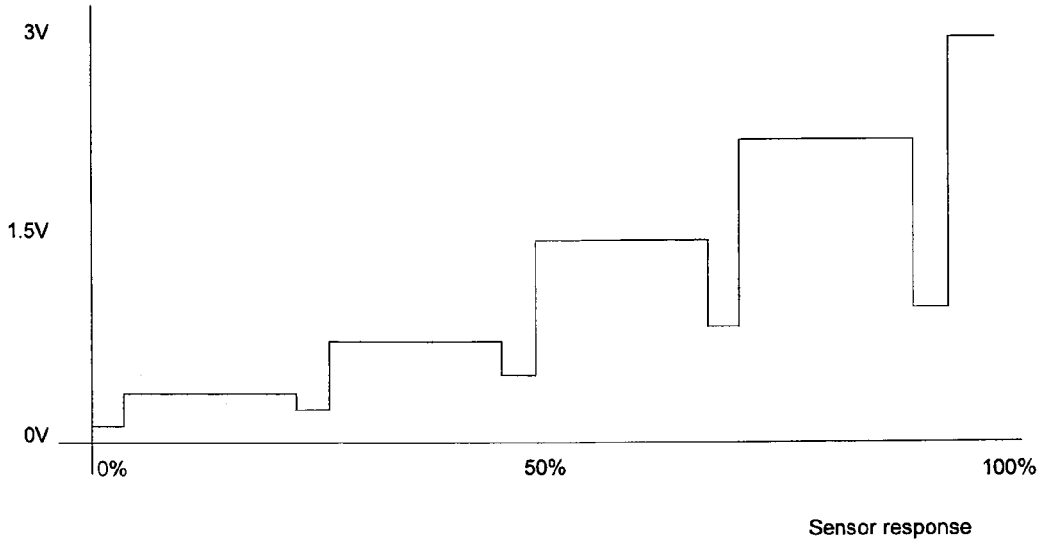
FIG. 15 is a graph illustrating a gradual increase in average amplitude within a motor pattern.

FIG. 15 is a graph showing gradually increasing motor amplitude without altering amplitude ratio, associated with a gradual increase in sensor output due to, for instance, increasing degree of bend or increasing degree of stretch or increasing degree of distance from distal end of an extremity.

Where the device features more than one motor, each may run a separate motor pattern. A motor in the internal end of the device is considered to be a rearward motor, and any motor in the staging section or, further, the external end is considered to be a forward motor. An in-situ gesture detected by a sensor can thus initiate a panning effect, called here motor panning, front to back or back to front, wherein the focus is increased in the forward motor and diminished in the rearward motor, or the converse. This may be done by switching one motor to a lighter motor pattern and the other motor to a heavier motor pattern. Or, motor panning may be done by increasing the average speed or amplitude of one motor and decreasing the average speed or amplitude of the other.

In some embodiments, motor panning involves more than two motors, such as where the highest motor focus pans from a motor in the internal end of the device, to one in the staging section of the device, to one in the external end of the device.

In the preferred embodiment, motor pattern, motor average amplitude, motor average period, and motor panning are separately controllable via varying in-situ gestures. However, simpler embodiments may have pre-set combinations of motor pattern, motor average amplitude, motor speed, and motor panning. Further, motor patterns may be simplified by having pre-set absolute amplitudes and periods, rather than being characterised by ratios. An embodiment of the device with more than one motor will typically be categorised as a shared toy and in-situ gestures associated will be shared toy gestures.

Further Aspects of In-Situ Sensing of Shared Toy Gestures

In another aspect of the invention, the control circuit may sense not just each in-situ gesture or shared toy gesture, but also may change motor patterns based on the velocity of gesture. In such cases, the control circuit uses the rate at which the resistance or capacitance of a sensor changes to determine a change in motor pattern.

Further, the frequency of in-situ gestures or shared toy gestures can also be used by the control circuit to determine a change in motor pattern. In an example illustrated via the graph of FIG. 16, a repeated in-situ gesture is sensed by a bend sensor, at a frequency given in gestures per second along the x-axis. An indicated curve 1600 shows the overall amplitude of a light motor pattern increasing as gesture frequency increases, beginning at a minimum point at 1601. In another example, reaching a set gesture frequency corresponds to an inflection point 1602 where the overall motor amplitude curve resets and begins curving upwards 1603 but with a heavier motor pattern, toward a maximum point at 1604.

Figure 16:
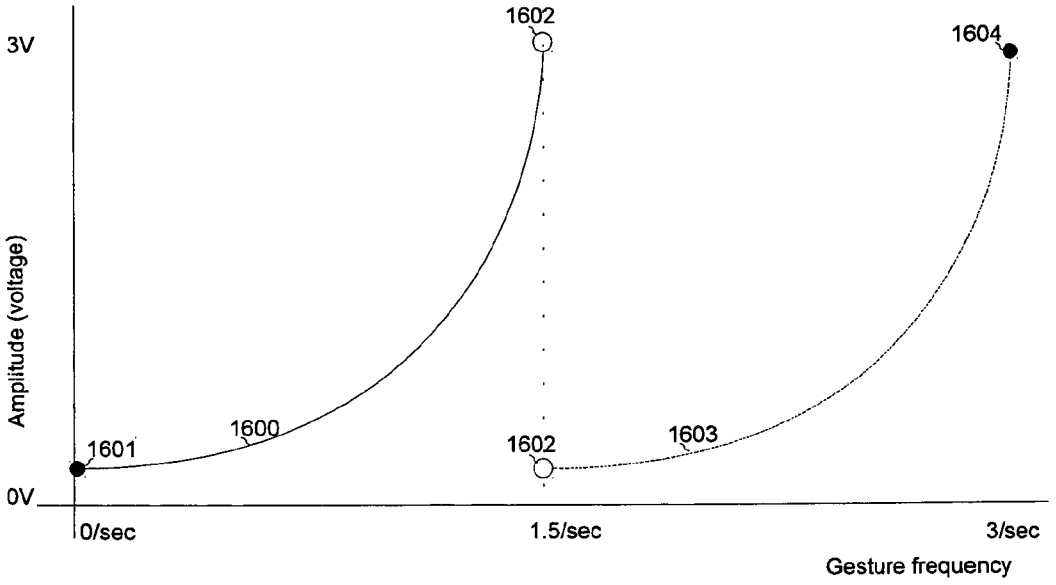
FIG. 16 is a graph illustrating a motor response that varies average amplitude for some degrees of sensor activation and switches motor pattern at an inflection point of sensor activation.
Figure 17:
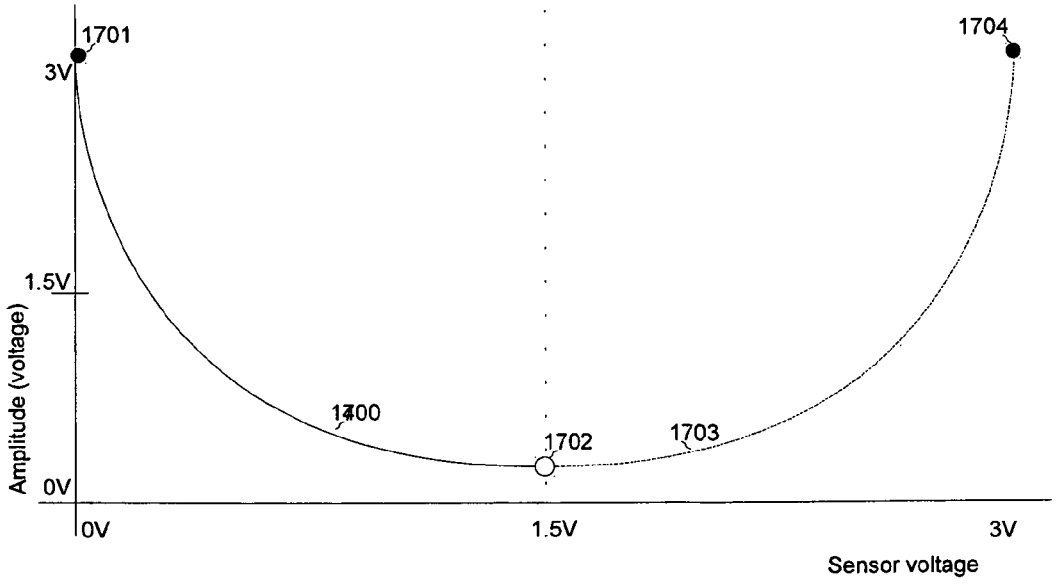
FIG. 17 is a graph illustrating a motor response that varies average amplitude for some degrees of sensor activation and switches motor pattern at an inflection point of sensor activation.

FIG. 17 shows the converse of FIG. 16, in which an indicated curve 1700 shows the overall amplitude of a motor pattern decreasing from a minimum point at 1701 to an inflection point at 1702. After the inflection point at 1702, a second curve 1703 shows the overall amplitude of a second motor pattern increasing to a maximum at 1704. In this embodiment, overall motor amplitude is not typically tied to gesture frequency, but to sensor voltage, as indicated by the X axis. In this way, the inflection point comes at the mid-point of activation of a sensor or array of sensors. This three-position relationship between motor and sensor is further explained below.

Three Position Sensing

Figure 18A:
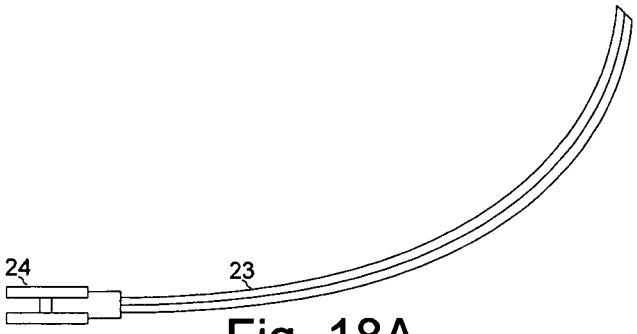
FIG. 18A illustrates a bend sensor as it is maximally bent while disposed longitudinally within the external end of an embodiment of the device.

FIG. 18A illustrates a bend sensor as it is maximally bent while disposed longitudinally within the external end of an embodiment of the device. The bend sensor 23 is connected with control circuitry by a pair of electrical leads 24. In an embodiment of the device which uses a three-position relationship between motor and sensors, when the flexible housing within which the bend sensor is bent beyond its resting shape, thus bending the bend sensor beyond its resting shape, the overall amplitude of a motor pattern is controlled. This sensor bending is thus correlated with a first motor pattern amplitude curve, such as curve 1300 in FIG. 13, or curve 1400 in FIG. 14. The maximum degree of bend which the control circuit is configured to sense is correlated with a start of an amplitude curve, as at point 1301 or 1401.

Figure 18B:
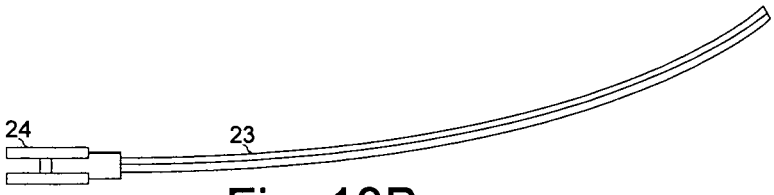
FIG. 18B portrays the bend sensor as it is at a rest shape, partially bent, while disposed longitudinally within the external end of an embodiment of the device.

FIG. 18B portrays the bend sensor as it is at a rest shape, partially bent, while disposed longitudinally within the external end of an embodiment of the device. The sensor is at a rest shape, partially bent, because the external end of the device has a curved shape. This middle or rest position is correlated with the inflection point 1302 on the graph of FIG. 13, or the inflection point 1402 on the graph of FIG. 14.

Figure 18C:
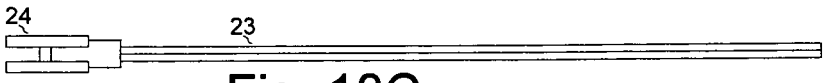
FIG. 18C portrays the bend sensor in an unbent, or straightened, shape, having been flexed from the partially bent rest shape.

FIG. 18C portrays the bend sensor in an unbent, or straightened, shape, having been flexed from the partially bent rest shape. This sensor bending is thus correlated with a second motor pattern amplitude curve, such as curve 1303 in FIG. 13, or curve 1403 in FIG. 14. The minimum degree of bend which the control circuit is configured to sense is correlated with an end of an amplitude curve, as at point 1304 or 1404. Note that, in some embodiments, the bend sensor can measure bending in two directions, in which case the inflection point of the motor pattern curve can correspond to a different degree of bend sensor flex than that of FIG. 18B.

Figure 19A:
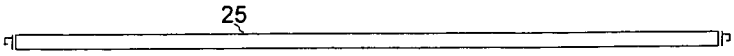
FIG. 19A illustrates a stretch sensor at the full stretch that the control circuit is configured to measure.
Figure 19B:
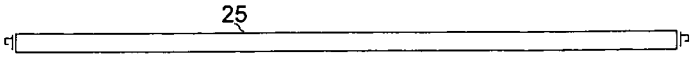
FIG. 19B illustrates a stretch sensor at a rest shape, partially stretched, while disposed longitudinally within the external end of an embodiment of the device.
Figure 19C:
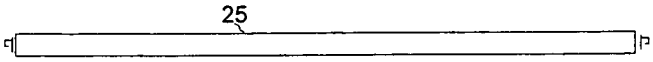
FIG. 19C illustrates a stretch sensor at the minimum stretch that the control circuit is configured to measure.

FIGS. 19A, 19B and 19C illustrate the corresponding three-position relationship between motor and sensor, for a stretch sensor rather than a bend sensor.

In FIG. 19A, the stretch sensor is at the full stretch that the control circuit is configured to measure, due to the flexible housing within which it is disposed having been so stretched. This sensor stretching is thus correlated with a first motor pattern amplitude curve, such as curve 1600 in FIG. 16, or curve 1700 in FIG. 17. The maximum degree of stretch which the control circuit is configured to sense is correlated with a start of an amplitude curve, as at point 1601 or 1701.

In FIG. 19B, the stretch sensor is at a rest shape, partially stretched, while disposed longitudinally within the external end of an embodiment of the device. The sensor is at a rest shape, partially stretched, because the flexible external end of the device may be either compressed or elongated from its rest shape. This middle or rest position is correlated with the inflection point 1602 on the graph of FIG. 16, or the inflection point 1702 on the graph of FIG. 17.

In FIG. 19C, the stretch sensor is at the minimum stretch that the control circuit is configured to measure, due to the flexible housing within which it is disposed having been so compressed. This disposition is analogous to the minimally bent shape of the bend sensor illustrated in FIG. 18C, and corresponds to the motor pattern graphs of FIG. 16 and FIG. 17 in the same manner.

Analogous methods of controlling a vibrator motor along an amplitude curve through an inflection point as described above in regard to FIG. 16 through FIG. 19 may also be applied to other types of sensors. For example, a squeeze or clench sensor disposed within the flexible housing could control a motor through two motor patterns, with the inflection point of the amplitude curve at partial clench of the sensor. The clench sensor can be of the pressure bulb type or one utilizing paired bend sensors. Further, a linear array of pressure or light sensors or other point sensors along the length of one end of the device could control a motor through two motor patterns, with the inflection point of the amplitude curve at the middle sensor of the array.

FIG. 20 is a table illustrating how motor patterns, motor panning, motor amplitude and motor period can be variously controlled in response to multiple sensors in an embodiment of the device. In the illustrated embodiment, the device employs a clench sensor, a stretch sensor as illustrated by FIG. 19 and a bend sensor as illustrated by FIG. 18, a linear array of pressure or light sensors along the external end of the device as illustrated in FIG. 4 by sensors 15 and 17, and a sensor disposed adjacent to the public bone of the user as illustrated by sensor 14 of FIG. 4. Sensor output control signals from these sensors are used to determine the control of a forward motor and a rearward motor.

The gestures recognized are listed in the first column of the table. The bend gesture, illustrated by FIG. 18A, causes motor amplitude panning by increasing rearward motor amplitude and decreasing the forward motor amplitude, keeping peak and trough amplitude ratios the same. Further, this gesture causes motor speed panning, increasing perceived forward motor speed (by decreasing both peak and trough periods), keeping peak and trough period ratios the same, and decreasing perceived rearward motor speed (by increasing both peak and trough periods).

The straighten gesture, the converse of the bend gesture, illustrated by FIG. 18C, causes motor amplitude panning converse to that of the bend gesture by decreasing rearward motor amplitude and increasing the forward motor amplitude, keeping peak and trough amplitude ratios the same. Further, this gesture causes motor speed panning, decreasing perceived forward motor speed (by increasing both peak and trough periods), keeping peak and trough period ratios the same, and increasing perceived rearward motor speed (by decreasing both peak and trough periods).

The third gesture in the table of FIG. 20, stretch, is a slight lengthening of the external end of the device, along that extremity's proximo-distal axis, registered by a stretch sensor disposed parallel to said proximo-distal axis, as illustrated by FIG. 19A. As indicated by the rightmost two columns of the table, this gesture causes an overall decrease in amplitudes of both motors and an overall increase in the perceived speeds of both motors by decreasing both peak and trough periods.

The fourth gesture in the table of FIG. 20, compress, is a shortening of the flexible external end of the device, along that extremity's proximo-distal axis, registered by a stretch sensor disposed parallel to said proximo-distal axis, as illustrated by FIG. 19C. As indicated by the rightmost two columns of the table, this gesture causes an overall increase in amplitudes of both motors and an overall decrease in the perceived speeds of both motors by increasing both peak and trough periods.

The fifth gesture in the table of FIG. 20, grasp-far, refers to a touch or grasp of the external end of the device more than half-way distant from the staging section, as would be registered by a pressure, light, clench or similar sensor disposed in the external end of the device in a linear array, as illustrated by sensor 17 of FIG. 4. As indicated by the leftmost four columns of the table, sensing this gesture sets the device to run motor patterns in the forward and rearward motors. As indicated, the forward motor amplitude ratio (peak/trough) is set to 10/1 and period ratio set to 2/1. The rearward motor amplitude ratio is set to 2/1 and period ratio set to 2/1.

The sixth gesture in the table of FIG. 20, grasp-near, refers to a touch or grasp of the external end of the device less than half-way distant from the staging section, as would be registered by a pressure, light, clench or similar sensor disposed in the external end of the device in a linear array, as illustrated by sensor 15 of FIG. 4. As indicated, sensing this gesture results in the forward motor amplitude ratio being set to 2/1 and period ratio set to 2/1. The rearward motor amplitude ratio is set to 10/1 and period ratio set to 2/1.

The seventh gesture in the table of FIG. 20, hip-press, refers to sensing by the hip-press sensor illustrated by sensor 13 of FIG. 4. As indicated, sensing this gesture results in the forward motor amplitude ratio being set to 6/1 and period ratio set to 4/1. The rearward motor amplitude ratio is set to 8/1 and period ratio set to 3/1.

The eighth gesture in the table of FIG. 20, clench, refers to sensing by a clench sensor situated in either the external or internal end of the device. As indicated, sensing this gesture results in the forward motor amplitude ratio being set to 8/1 and period ratio set to 3/1. The rearward motor amplitude ratio is set to 6/1 and period ratio set to 4/1.

The ninth gesture in the table of FIG. 20, unclench, refers to none of the motor pattern setting gestures (fifth through ninth) being sensed. As indicated, this defaults to the forward motor amplitude ratio being set to 2/1 and period ratio set to 4/1. The rearward motor amplitude ratio is set to 2/1 and period ratio set to 4/1.

Motor patterns are discrete. Gestures listed later in the table take priority over gestures listed earlier in the table for setting motor patterns. Different embodiments may match gestures with motor responses differently.

Multiple-Frequency Sensing

Figure 21:
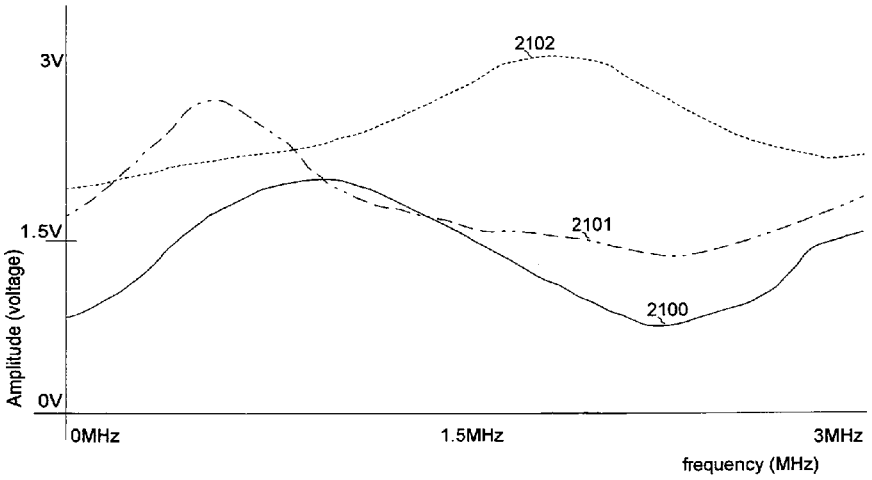
Fig. 21 PRIOR ART
FIG. 21 (Prior Art) is a graph showing example multiple-frequency sensing response curves for various touches as sensed using multiple-frequency capacitive sensing.

FIG. 21 (Prior Art) is a voltage over frequency graph showing example multiple-frequency sensing response curves for various touches as sensed using multiple-frequency capacitive sensing. Whereas the bend, strain and other types of sensors disclosed above output only a single response variable, such as DC voltage or phase, multiple-frequency capacitive touch sensing uses AC signals at a broad spectrum of frequencies across a conductive object, or an object embedded with an electrode, to sense gestures.

In the typical use of capacitive sensing, familiar to most from touch-screen smartphones, a conductive object is excited by an electrical signal at a set frequency. The sensing circuit monitors the return signal and finds touch events by recognizing changes in the signal caused due to the capacitance of the human body touching the object. In multiple-frequency capacitive sensing, a range of frequencies is monitored for responses to capacitive human touch. Two different monitored objects respond differently to touches across the monitored frequencies, and a monitored object responds differently to different touches. Thus, not only can a touch event be detected, but the way in which the touch occurs—hand and body arrangements, the location of the touch on an object—can be determined via comparison of known sets of frequency response data points to the monitored changes. Further, multiple-frequency capacitive sensing is capable of accurate response in the humid circumstances of the human body.

Multiple-frequency capacitive sensing requires a sensing circuit capable of generating and rapidly analyzing the range of signal frequencies, and an electrode to carry those frequencies embedded in the touch object. One approach to generating said range of frequencies is to produce a sinusoidal signal encompassing the desired frequencies. An example of a commercially available integrated circuit capable of generating a such a wave is the AD9833BRMZ Prog Waveform Gen IC built by Analog Devices. In some cases, it is desirable to use a less expensive integrated circuit that produces a noisier square wave, such as the more common ATmega128 built by Atmel. In these cases, it is necessary to include an LC noise-filtering circuit in the signal return path. Further discussion of multiple-frequency capacitive sensing can be found in the paper by Sato, M., Poupyrev, I, and Harrison, C. Touché, "Enhancing Touch Interaction on Humans, Screens, Liquids, and Everyday Objects" presented at the ACM SIGCHI Conference on Human Factors in Computing Systems, May 5-10, 2012, located at www.disneyresearch.com/wp-content/uploads/touchechi2012.pdf The frequency response curve for a particular touch will be different for each different object, depending on shapes and materials. FIG. 21 illustrates example response curves. Curve 2100 of FIG. 21 illustrates example responses across monitored frequencies for a one-finger touch of a hypothetical object embedded with a sensing electrode. Curve 2101 illustrates example responses across monitored frequencies for a touch by two separated fingers of the same object. Curve 2102 illustrates example responses for the same two-fingered touch of a different object, of different shape or composition, embedded with a sensing electrode.

Multiple-Frequency Sensing of Shared Toy Gestures

Figure 22:
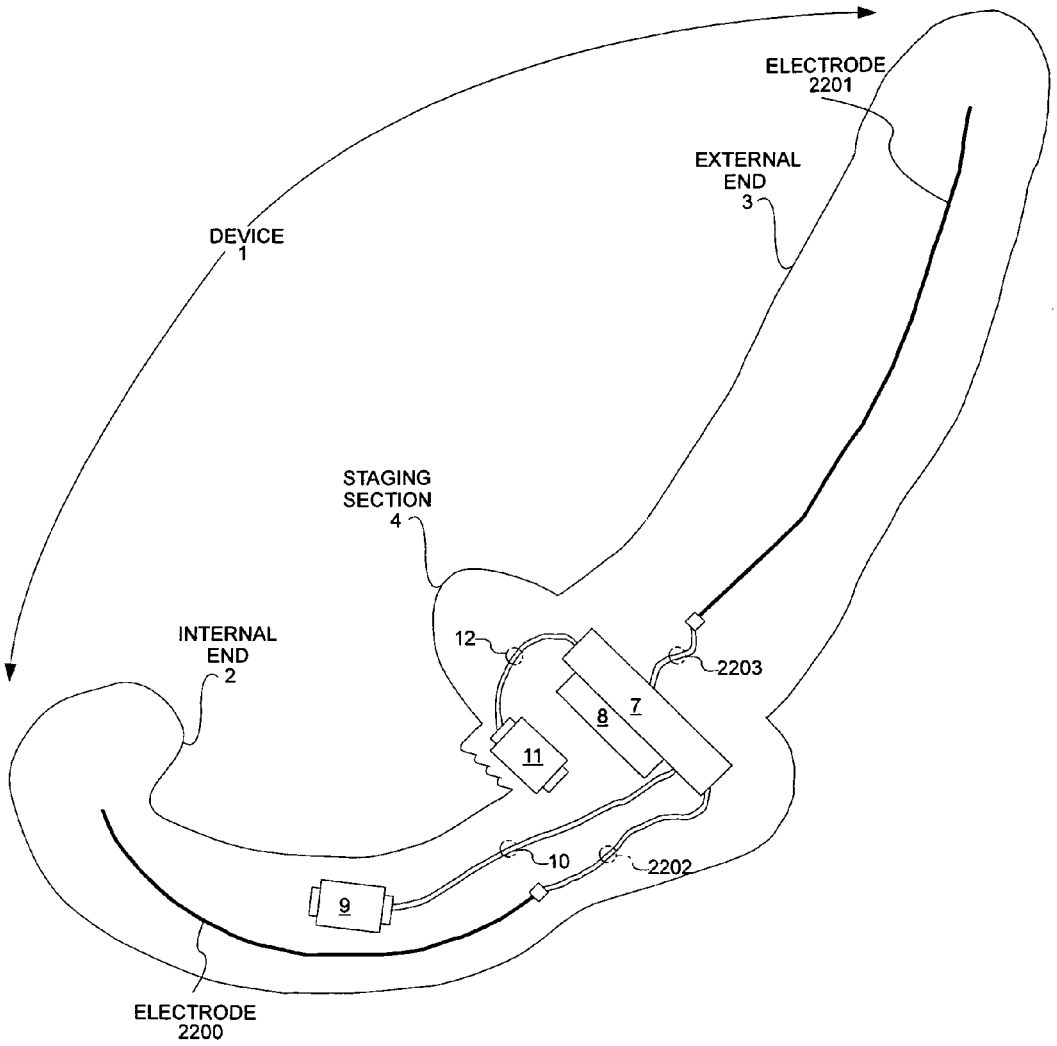
FIG. 22 illustrates an embodiment of the invention using a multiple-frequency touch sensing electrode.

In one novel aspect of the invention, multiple-frequency touch sensing is used to sense in-situ gestures generally, and shared toy gestures more particularly, of the user or an additional user touching the external end, internal end, or staging section of the device. FIG. 22 illustrates an embodiment of the invention wherein a first multiple-frequency touch sensing electrode 2200 is embedded in the internal end 2 of the device 1 and a second multiple-frequency touch sensing electrode 2201 is embedded in the external end 3 of the device 1.

First electrode 2200 is connected to control circuit 7 by electrical lead 2202. Second electrode 2201 is connected to control circuit 7 by electrical lead 2203.

Control circuit 7 sends through each electrode an electrode output signal that sweeps through a range of frequencies and receives a multiple-frequency electrode return signal. For each gesture recognized by the device, a multiple-frequency sensing profile is stored in memory on the control circuit 7. The control circuit 7 recognizes shared toy gestures, and similar in-situ gestures, performed against portions of the device 1 containing electrodes as closely matching these multiple-frequency sensing profiles. Using this recognition as well as other sensor information such as bend and stretch sensor inputs, frequency of gestures sensed, and patterns and combinations of gestures sensed, the control circuit 7 initiates changes to motor patterns, as discussed above.

In this manner, the user or users need not choose a particular motor pattern or intensity, but, rather, has the device 1 respond naturally to in-situ gestures. In the pictured embodiment, the control circuit 7 controls motor 9, in the internal end 2, via lead 10 and motor 11, in the staging section 4, via lead 12.

Figure 23:
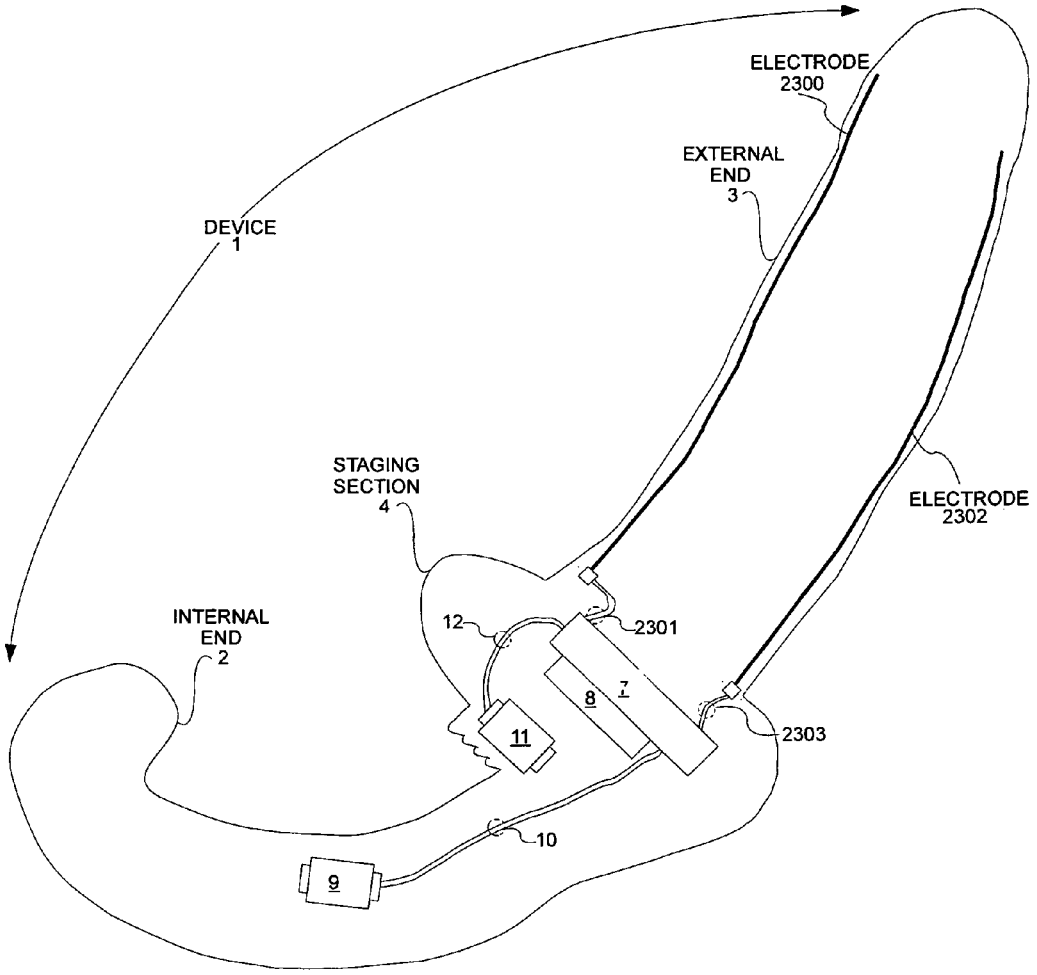
FIG. 23 illustrates ventral and dorsal placement of a multiple-frequency touch sensing electrode.

FIG. 23 illustrates embodiments placing an electrode in a dorsal or ventral location in the external end 3 of the device 1. Electrode in the dorsal position 2300 is connected to the control circuit 7 via lead 2301. Electrode 2302 in the ventral position is connected to the control circuit 7 via lead 2303. Electrodes are embedded in the flexible material of the device's housing just under the dorsal surface of the external end 3, in order to maximize electrode sensitivity.

Shared Toy Gestures

In addition to the gestures disclosed above in regard to bend, stretch and similar sensors, the following shared toy gestures are disclosed as being detectable in the device using multiple-frequency sensing and associated with controlling the device's motors in selected patterns and varying the intensity within a motor pattern.

Figure 24:
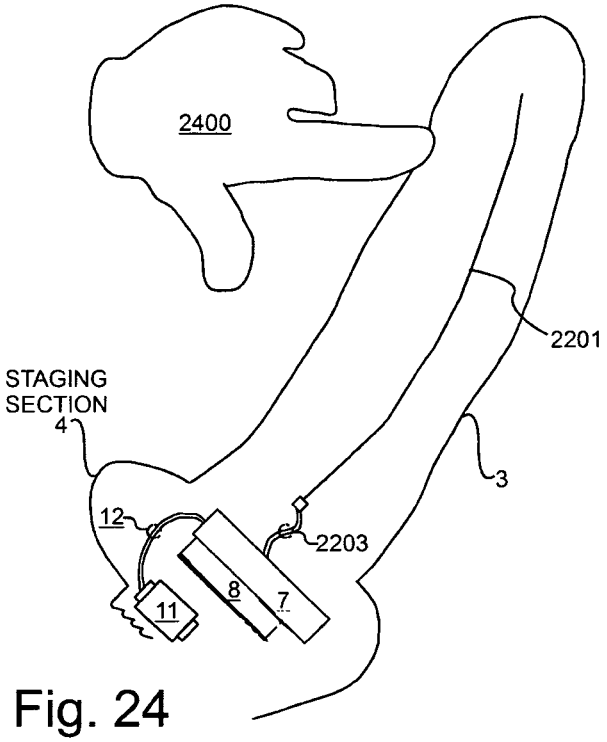
FIG. 24 illustrates a basic one-finger touch gesture.

FIG. 24 illustrates a basic one-finger touch gesture. A stylized representation of a hand 2400 is touching the external end 3 of the device 1 with one finger. Because the external end 3 is embedded with a multiple-frequency sensing electrode 2201, a multiple-frequency return control signal is sent to the control circuit 7, which recognizes the sensor control signal as being most similar to the multiple-frequency sensing profile associated with this gesture in a device of this shape. This in-situ gesture recognition, along with recognition of prior and concurrent gestures, is used to determine a motor pattern for one or more motors in the device 1.

Figure 25:
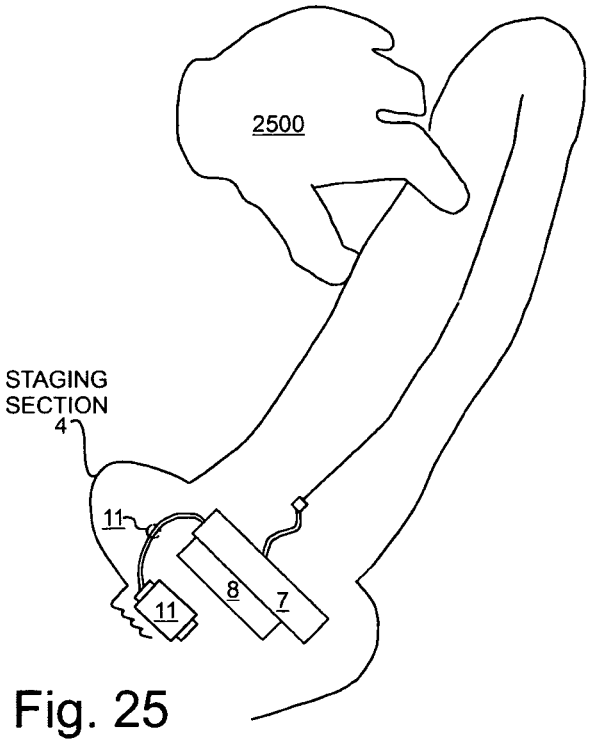
FIG. 25 illustrates a static two-finger pinch gesture.

Separate gestures can be recognized for a basic touch by two, three or more fingers, or even an elbow. Each separate gesture recognition can be so used in determining motor patterns. As an example, FIG. 25 illustrates a static two-finger pinch gesture, being performed by a stylized hand 2500, that can be so recognized by the device 1.

Figure 26:
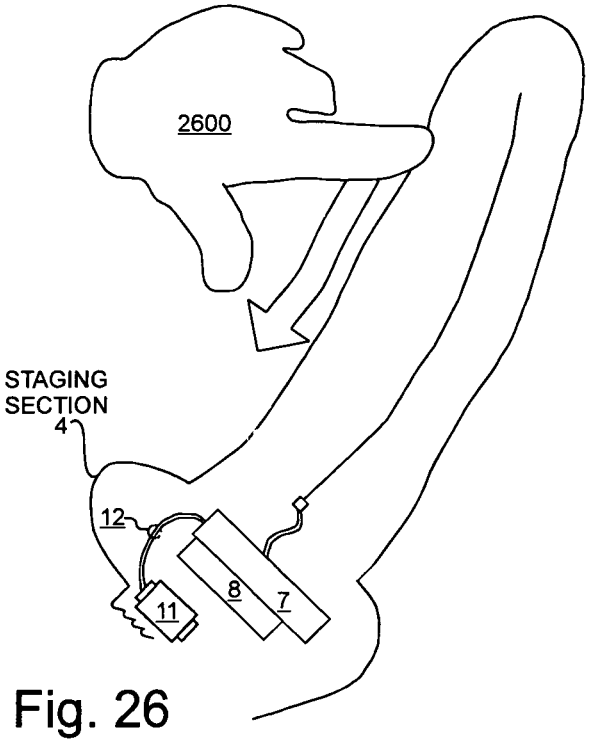
FIG. 26 is a stylized illustration of a hand performing a one-fingered draw toward gesture.

FIG. 26 is a stylized illustration of a hand 2600 performing a one-fingered draw toward gesture, dragging away from the distal end of the external end 3 and toward the proximal end.

Figure 27:
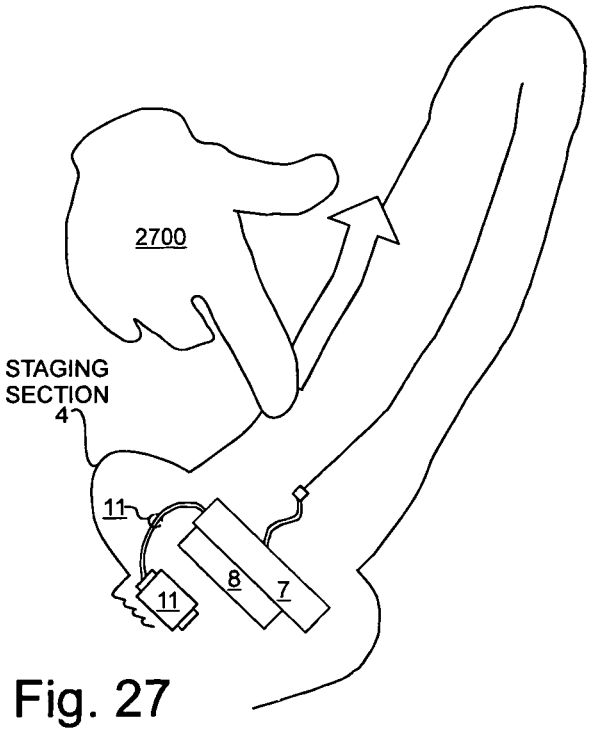
FIG. 27 is a stylized illustration of a hand performing a one-fingered draw away gesture.

FIG. 27 is a stylized illustration of a hand 2700 performing a one-fingered draw away gesture, dragging toward the distal end of the external end 3 and away from the proximal end.

Figure 28:
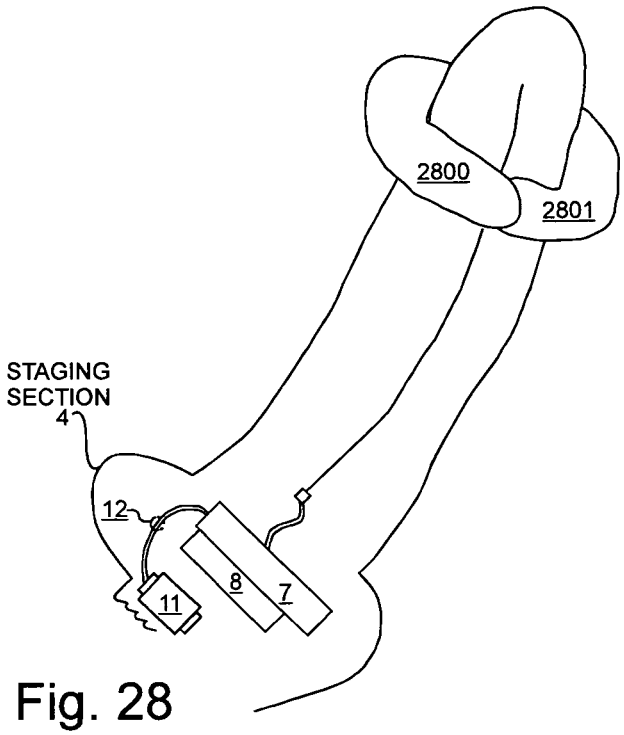
FIG. 28 illustrates an encircle far gesture.

FIG. 28 illustrates an embodiment in which the device 1 senses a gesture here called encircle far. External end 3 of the device 1 is assumed to be substantially cylindrical, phallic or in the shape of a curved cylinder, such that a normal adult human hand can encircle the external end 3 using a thumb and finger.

A stylized illustration of a finger 2800 and thumb 2801 are shown encircling the external end 3 of the device 1 at the far end of the external end 3 more than two-thirds distant from the staging section 4. Depending on the embodiment, sensing encircle far can be associated with any motor effect, but in the preferred embodiment, sensing encircle far is associated with a light motor pattern and with varying the intensity of a forward motor.

While encircle far is first described here as being performed by a finger and thumb of a first user or a second user, it is important to note that encircle far and all other encircle gestures described below can also be performed by the mouth or orifice of the user or a second user. The multiple-frequency return control signal will vary depending on which area of the body is used to perform an encircle gesture, so several different one multiple-frequency sensing profiles can be associated with a given gesture, but the associated motor patterns remain consistent to the sensed gesture.

Figure 29:
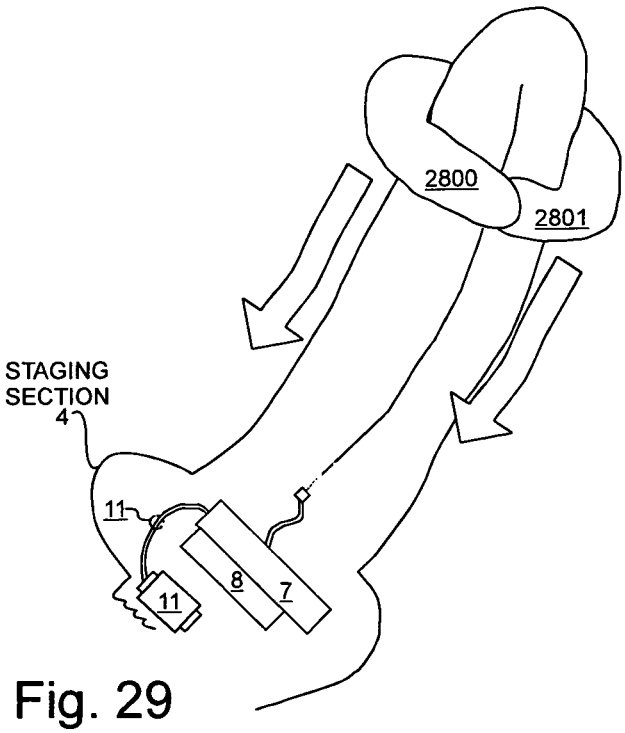
FIG. 29 illustrates an encircle drag toward gesture.

FIG. 29 illustrates sensing an in-situ gesture called encircle drag toward, in which the encircling gesture is dragged toward the staging section 4. Depending on the embodiment, sensing encircle drag toward can be associated with any motor effect, but, in the preferred embodiment, sensing encircle drag toward is associated with increasing the intensity of a motor pattern and with rearward motor panning. Encircle drag toward arrives at the encircle near gesture.

Figure 30:
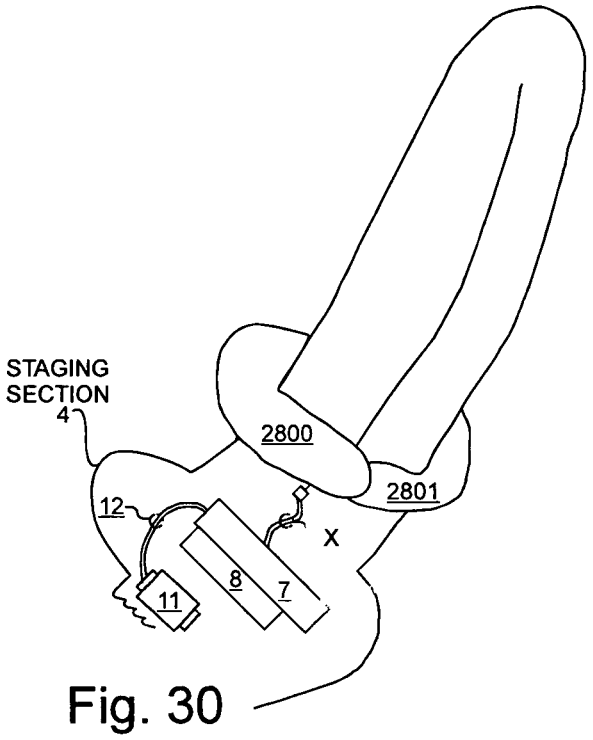
FIG. 30 illustrates an encircle near gesture.

The converse of encircle far, called encircle near, is illustrated by FIG. 30, in which a stylized illustration of a finger 2800 and thumb 2801 are shown encircling the external end 3 of the device 1 at the near end of the external end 3 less than one-third distant from the staging section 4.

In the preferred embodiment, sensing encircle near is associated with a heavy motor pattern and with varying the intensity of a rearward motor.

Figure 31:
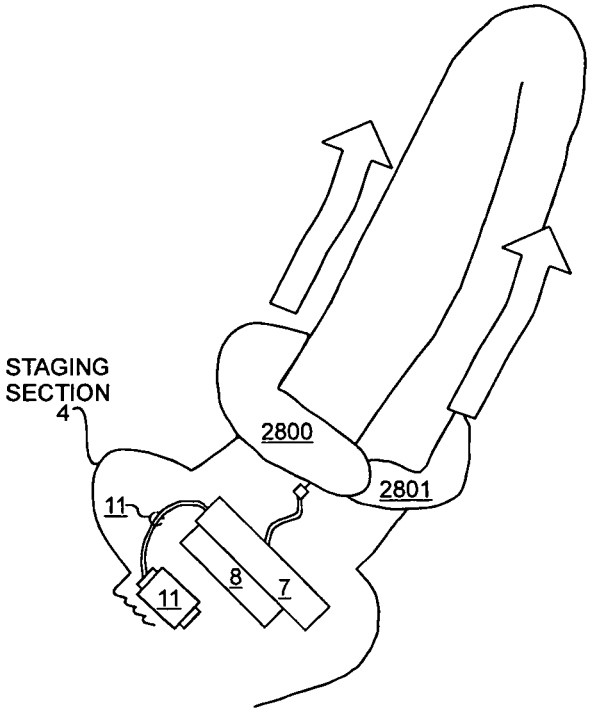
FIG. 31 illustrates an encircle drag away gesture.

FIG. 31 illustrates sensing a gesture called encircle drag away, in which the encircling gesture is dragged away from the staging section 4 and terminates, if taken to its conclusion, in encircle far. In the preferred embodiment, sensing encircle drag away is associated with decreasing the intensity of a motor and with motor panning toward the fore of the device 1.

Figure 32:
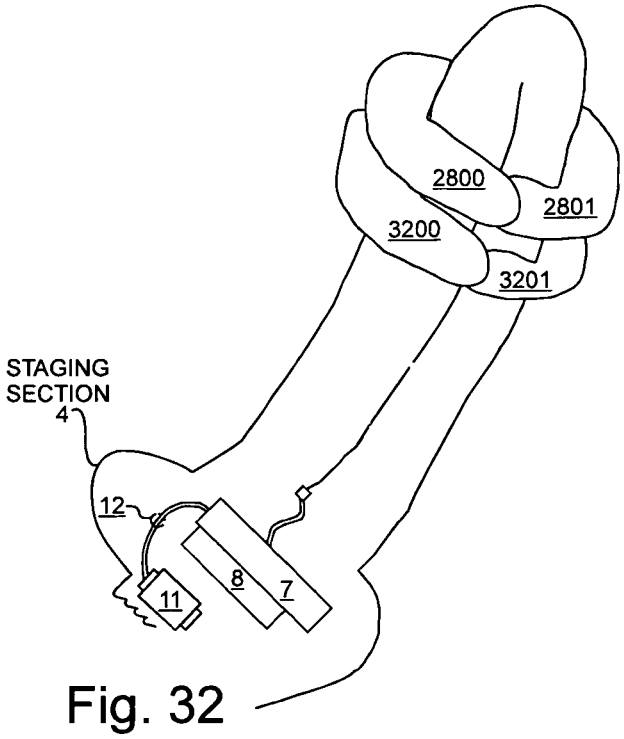
FIG. 32 illustrates a double encircle far gesture.

FIG. 32 illustrates sensing an gesture called double encircle far. A stylized illustration of a finger 2800 and thumb 2801 of a user or a second user are shown encircling the external end 3 of the device 1 at the far end of the external end 3 more than two-thirds distant from the staging section 4. A stylized illustration of a second set of finger 3200 and thumb 3201 of a user or a second user are shown encircling the external end 3 of the device 1 adjacent to the first finger and thumb encirclement. In the preferred embodiment, sensing double encircle far is associated with varying the intensity of a forward motor and with a motor pattern heavier than the motor pattern associated with encircle far.

Figure 33:
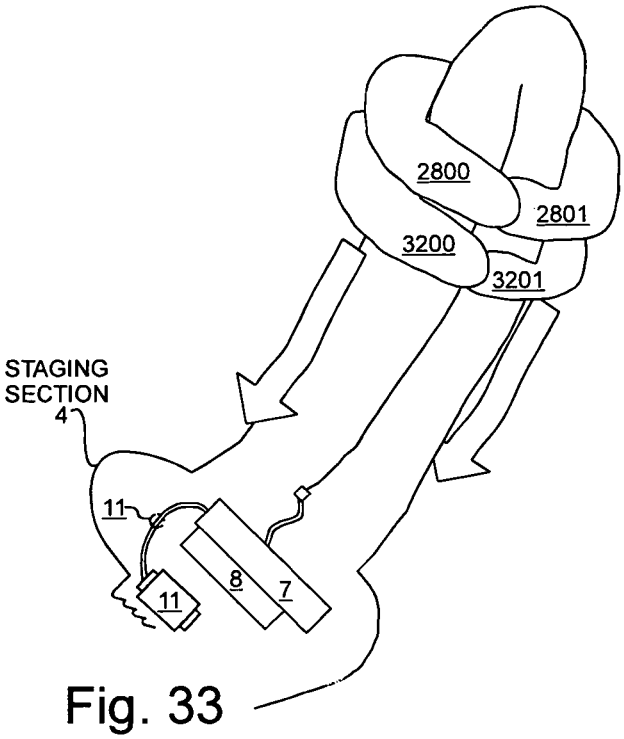
FIG. 33 illustrates a double encircle drag toward gesture.

FIG. 33 illustrates sensing a gesture called double encircle drag toward, in which the rearward finger 3200 and thumb 3201 performing the encircling gesture are dragged toward the staging section 4. In the preferred embodiment, sensing double encircle drag toward is associated with increasing the intensity of a motor, with rearward motor panning and with a heavier motor pattern in a forward motor than is associated with encircle drag toward. Double encircle drag toward arrives &t the split encircle gesture.

Figure 34:
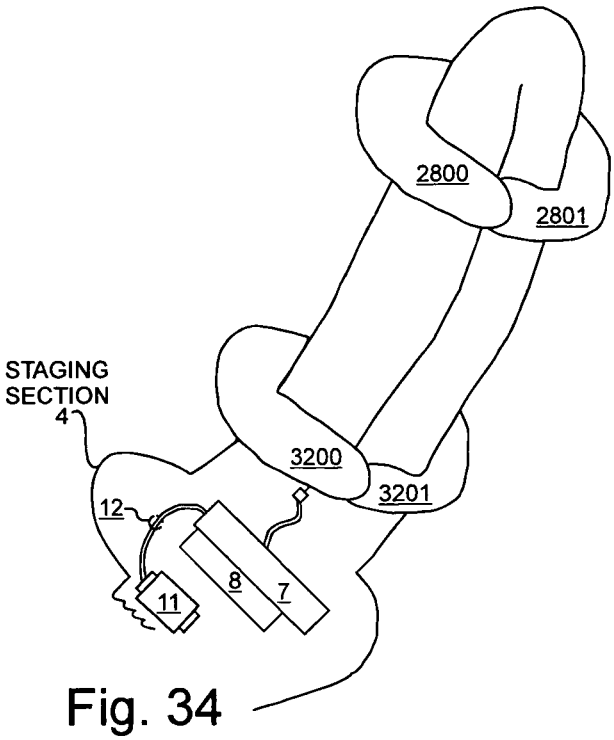
FIG. 34 illustrates a split encircle gesture.

FIG. 34 illustrates sensing a gesture called split encircle. A stylized illustration of a finger 2800 and thumb 2801 of a user or a second user are shown encircling the external end 3 of the device 1 at the far end of the external end 3 more than two-thirds distant from the staging section 4. A stylized illustration of a second set of finger 3200 and thumb 3201 of a user or a second user are shown encircling the external end 3 of the device 1 less than one-third distant from the staging section. In the preferred embodiment, sensing split encircle is associated with varying the intensity of one or both of a forward motor and a rearward motor, and with setting a forward and rearward motor to the same motor pattern.

Figure 35:
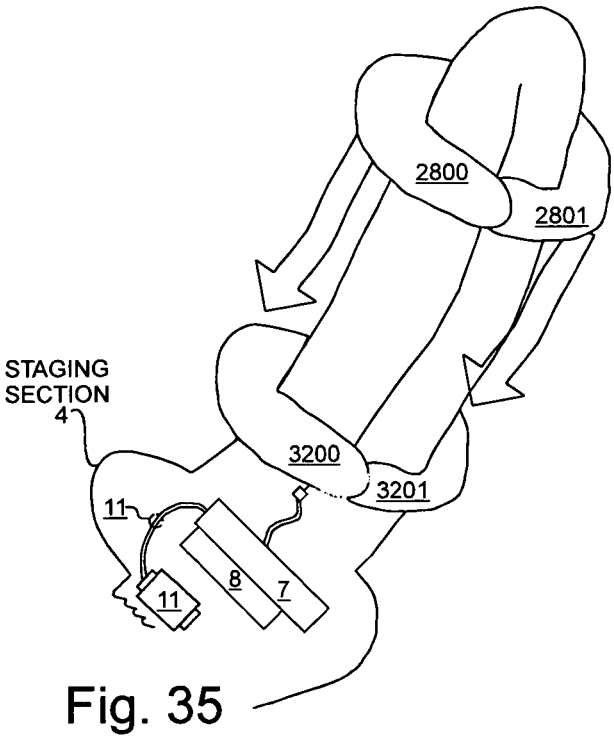
FIG. 35 illustrates a split encircle drag toward gesture.

FIG. 35 illustrates sensing a gesture called split encircle drag toward, in which the rearward finger 2800 and thumb 2801 performing the split encircle gesture are dragged toward the staging section 4. In the preferred embodiment, sensing split encircle drag toward is associated with increasing the intensity of a motor, with rearward motor panning and with a heavier motor pattern in a rearward motor than is associated with encircle drag toward. Split encircle drag toward arrives at the double encircle near gesture.

Figure 36:
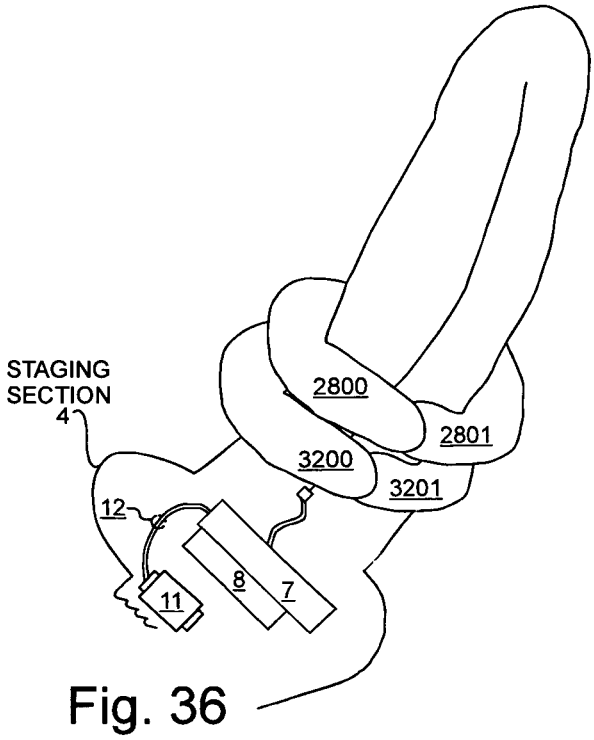
FIG. 36 illustrates a double encircle near gesture.

The converse of double encircle far, called double encircle near, is illustrated by FIG. 36, in which a stylized illustration of a finger 2800 and thumb 2801 of a user or a second user are shown encircling the external end 3 of the device 1, adjacent with a second set of finger 3200 and thumb 3201 of a user or a second user. In the preferred embodiment, sensing double encircle near is associated with a heavy motor pattern, with varying the intensity of a rearward motor and with a heavier motor pattern in a rearward motor than is associated with encircle near.

Figure 37:
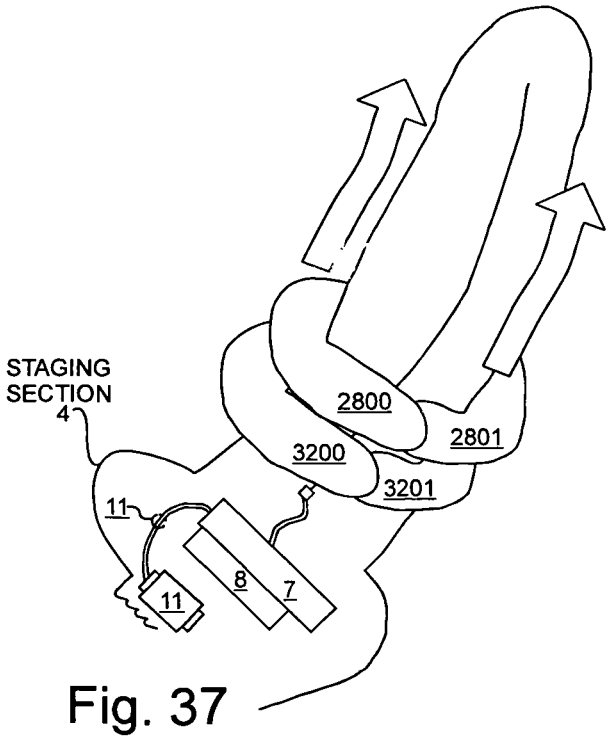
FIG. 37 illustrates a double encircle drag away gesture.

FIG. 37 illustrates sensing a gesture called double encircle drag away, in which the forward finger 2800 and thumb 2801 performing the encircling gesture are dragged away from the staging section 4. In the preferred embodiment, sensing double encircle drag away is associated with decreasing the intensity of a motor, with forward motor panning and with a heavier motor pattern in a rearward motor than is associated with encircle drag away. Double encircle drag away arrives at the split encircle gesture.

Figure 38:
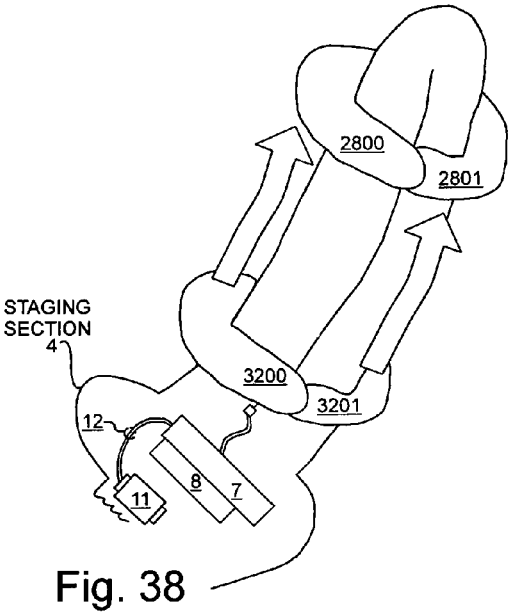
FIG. 38 illustrates a split encircle drag away gesture.

FIG. 38 illustrates sensing a gesture called split encircle drag away, in which the rearward finger 3200 and thumb 3201 performing the split encircle gesture are dragged away from the staging section 4. In the preferred embodiment, sensing split encircle drag toward is associated with decreasing the intensity of a motor, with forward motor panning and with a heavier motor pattern in a forward motor than is associated with encircle drag away.

FIG. 39 is a table illustrating how motor patterns, motor panning, motor amplitude and motor period can be variously controlled in response to multiple-frequency sensing in an embodiment of the device. In the illustrated embodiment, the device employs a multiple-frequency sensing electrode and a bend sensor as illustrated by FIG. 15. Signals from these sensors cause the control circuit to control a forward motor and a rearward motor.

The gestures recognized via the multiple-frequency sensing electrode are listed in the first column of the table. Concurrently with each such listed gesture is the possibility of sensing bending or straightening of the bend sensor. Generally, here, static grasp gestures select a motor pattern, and dragging or bending are reacted to by the control circuit varying motor speeds or amplitudes, as indicated.

As indicated by the second through fifth columns of the table, sensing the encircle far gesture sets the device to run motor patterns in the forward and rearward motors. As indicated, the forward motor amplitude ratio (peak/trough) is set to 8/1 and period ratio set to 1/2. The rearward motor amplitude ratio is set to 4/1 and period ratio set to 1/2. Sensing a concurrent bend gesture causes both motor amplitudes to increase and speeds to decrease by lengthening peak and trough periods. Conversely, sensing a concurrent straighten gesture causes both motor amplitudes to decrease and speeds to increase by shortening peak and trough periods.

The next gesture, encircle drag toward, retains the motor patterns of the encircle far gesture until the encircle near gesture (or some other static gesture) is sensed. As the sixth column of the table indicates, the dragging portion of the gesture causes rearward motor panning, such that the rearward motor speed and amplitude increase while the forward motor speed and amplitude decrease with further dragging toward.

The third gesture, encircle near, sets the forward motor amplitude ratio to 4/1 and period ratio to 1/1. The rearward motor amplitude ratio is set to 8/1 and period ratio set to 1/1. Sensing a concurrent bend gesture causes both motor amplitudes to increase and speeds to decrease by lengthening peak and trough periods. Conversely, sensing a concurrent straighten gesture causes both motor amplitudes to decrease and speeds to increase by shortening peak and trough periods.

The fourth gesture, encircle drag away, retains the motor patterns of the encircle near gesture until the encircle far gesture (or some other static gesture) is sensed. The dragging portion of the gesture causes forward motor panning, such that the forward motor speed and amplitude increase while the rearward motor speed and amplitude decrease with further dragging away.

The fifth gesture, double encircle far, sets the forward motor amplitude ratio to 10/1, and period ratio to 2/1. The rearward motor amplitude ratio is set to 2/1 and period ratio set to 2/1. Sensing a concurrent bend gesture causes both motor amplitudes to decrease and speeds to increase by shortening peak and trough periods. Conversely, sensing a concurrent straighten gesture causes both motor amplitudes to increase and speeds to decrease by lengthening peak and trough periods.

The sixth gesture, double encircle drag toward, retains the motor patterns of the double encircle far gesture until the encircle far gesture (or some other static gesture) is sensed. The dragging portion of the gesture causes rearward motor amplitude panning.

The seventh gesture, split encircle, sets the forward motor amplitude ratio to 6/1 and period ratio to 3/1. The rearward motor amplitude ratio is set to 6/1 and period ratio set to 3/1. Sensing a concurrent bend gesture causes forward motor amplitude panning. Sensing a concurrent straighten gesture causes rearward motor amplitude panning.

The eighth gesture, split encircle drag toward, retains the motor patterns of the split encircle gesture until the encircle far gesture (or some other static gesture) is sensed. The dragging portion of the gesture causes rearward motor speed panning.

The ninth gesture, double encircle near, sets the forward motor amplitude ratio to 2/1 and period ratio to 4/1. The rearward motor amplitude ratio is set to 10/1 and period ratio set to 4/1. Sensing a concurrent bend gesture causes both motor amplitudes to decrease and speeds to increase by shortening peak and trough periods. Conversely, sensing a concurrent straighten gesture causes both motor amplitudes to increase and speeds to decrease by lengthening peak and trough periods.

The tenth gesture, double encircle drag away, retains the motor patterns of the double encircle near gesture until the split encircle far gesture (or some other static, gesture) is sensed. The dragging portion of the gesture causes forward motor amplitude panning.

The eleventh gesture, split encircle drag away, retains the motor patterns of the split encircle gesture until the double encircle far gesture (or some other static gesture) is sensed. The dragging portion of the gesture causes forward motor speed panning.

Sensing no gesture defaults to forward and rear motor amplitude ratios of 1.5/1 and period ratios of 1/1.

Motor patterns are discrete. Different embodiments may match gestures with motor responses differently and may also combine with other sensors and gestures, such as those discussed in regard to FIG. 20. The above shared toy gestures are illustrated as being performed on the external end 3 of the device 1. Depending on the shape of the housing of the device, said in-situ gestures can be conceived of as being sensed by sensors in the internal end 2 or staging section 4 of the device 1.

Materials and Construction

While invention is described as being constructed of the typical silicone or a similar material, certain alternate materials are disclosed here as modifications. First, as the invention may be worn by a user, it is advantageous to reduce weight. Thus, a modified design may call for a lighter weight battery, at the expense of operating time. Additionally, a lighter weight flexible material, such as foamed silicone, may replace some of the solid silicone of the body. In such an embodiment, a foamed silicone core is assembled with the circuitry, and then covered by an outer layer of solid silicone.

Further, certain materials may be substituted to increase electrode sensitivity. In one embodiment, the solid flexible surface of the invention may have increased low-amperage conductivity by using conductive graphite powder in the silicone material, or by using conductive fluorosilicone. Alternately, the electrodes may be made of said conductive silicone, or of graphene rubber, allowing electrode placement at or near the surface of the flexible invention body.

Thus, it is seen that the invention may be constructed by first molding an inner core of flexible material, leaving cavities for placement of batteries, control circuit and motors. Sensors and electrodes may then be adhered to the inner core. An outer layer of flexible material may then be molded over the inner layer, motors, sensors, electrodes and circuitry. The molding of the outer layer of flexible material leaves room for a removable fitted plug of flexible material that covers access to batteries or recharging port. Flexible electrodes may be adhered to the outer surface when the outer layer is molded.

Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. An apparatus comprising:

a housing of flexible material, said housing comprising an internal extremity having an internal extremity proximo-distal axis, said internal extremity proximo-distal axis being either curved or straight, and an external extremity proximo-distal axis, said external extremity proximo-distal axis being either curved or straight;

a control circuit configured to recognize at least a sensor output control signal and produce at least a motor input control signal in response, wherein said control circuit is configured to produce a first motor pattern comprising a series of motor input control signals, each motor input control signal of said first motor pattern corresponding to a peak having a period and an amplitude or to a trough having a period and an amplitude, and wherein a given motor pattern is characterised by a peak-to-trough amplitude ratio and a peak-to-trough period ratio;

at least a first touch sensor, connected to said control circuit by a first lead, that produces a first sensor output control signal in response to a first in-situ gesture and a second sensor output control signal in response to a second in-situ gesture, said first touch sensor having a first touch sensor lengthwise axis, said first touch sensor being disposed such that the first touch sensor lengthwise axis is parallel to the internal extremity proximo-distal axis or is parallel to the external extremity proximo-distal axis;

at least a motor, wherein a speed of said motor varies in response to said motor input control signal, wherein said apparatus is a sex toy.

2. The apparatus of claim 1, having a first sensor trigger-point output voltage, wherein said first sensor output control signal has a voltage and said second sensor output control signal has a voltage, wherein said first sensor is a bend sensor or else a stretch sensor, wherein the second sensor output control signal having a voltage higher than the first sensor trigger-point output voltage causes said control circuit to produce a first motor pattern, and wherein the second sensor output control signal having a voltage lower than the first sensor trigger-point output voltage causes said control circuit to produce a second motor pattern.

3. The apparatus of claim 1, wherein a motor pattern may be varied in intensity by varying its average amplitude or by varying its average period, wherein a first in-situ gesture is associated with outputting a motor pattern and a second in-situ gesture is associated with varying the intensity of the motor pattern.

4. The apparatus of claim 1, further comprising a second motor, wherein a third in-situ gesture is associated with motor panning.

5. The apparatus of claim 1, further comprising:

a second motor; and a non-transitory computer-readable medium that stores computer-executable instructions causing said control circuit to produce at least a motor input control signal based on an association between an in-situ gesture and a motor response, wherein said association is taken from the group comprising:

a bend gesture associated with motor panning;

a straighten gesture associated with motor panning;

a stretch gesture associated with varying an intensity of a motor;

a compress gesture associated with varying an intensity of a motor pattern;

a grasp-far gesture associated with a heavy motor pattern in a forward motor;

a grasp-near gesture associated with a heavy motor pattern in a rearward motor;

a grasp-far gesture associated with a light motor pattern in a rearward motor;

a grasp-near gesture associated with a light motor pattern in a forward motor;

a hip press gesture associated with a heavy motor pattern in a forward motor;

a hip press gesture associated with a heavy motor pattern in a rearward motor;

a clench gesture associated with a heavy motor pattern in a forward motor;

a clench gesture associated with a heavy motor pattern in a rearward motor;

an unclench gesture associated with a light motor pattern in a forward motor;

an unclench gesture associated with a light motor pattern in a rearward motor.

6. An apparatus comprising:

a housing of flexible material, said housing comprising:

an external extremity having a tip, an internal extremity having a tip, and a middle portion, said external extremity having a proximal end contiguous to said middle portion, a distal end being the tip of the external extremity furthest from said middle portion and an external extremity proximo-distal axis extending through the external extremity from its proximal end to its distal end, said internal extremity having a proximal end contiguous to said middle portion, a distal end being the tip of the internal extremity furthest from said middle portion and an internal extremity proximo-distal axis extending through the internal extremity from its proximal end to its distal end, a control circuit configured to generate a first multiple-frequency electrode output signal, receive a first multiple-frequency electrode return signal, and to produce a first motor input control signal in response;

a first electrode, connected to said control circuit by a first lead, configured to conduct said first multiple-frequency electrode output signal, and to conduct said first multiple-frequency electrode return signal in response to a first in-situ gesture, said first electrode being disposed on or within the flexible material of said external extremity, said first electrode and first lead extending from the proximal end of said external extremity and partially or fully toward, but not beyond, the distal end of said external extremity; and a primary motor having a behavior and having an average amplitude, wherein the behavior of said primary motor varies in response to said first motor input control signal, wherein said apparatus is a sex toy.

7. The apparatus of claim 6, wherein said first in-situ gesture is taken from the group consisting of: encircle far, encircle drag toward, encircle near, encircle drag away, double encircle far, double encircle drag toward, split encircle, split encircle drag toward, double encircle near, double encircle drag away, split encircle drag away.

8. The apparatus of claim 6, further comprising a non-transitory computer-readable medium that stores computer-executable instructions causing the control circuit to perform the steps of:

receiving said first multiple-frequency electrode return signal;

recognizing said first in-situ gesture in response to which said first multiple-frequency electrode return signal was produced;

determining a first motor behavior associated with said first in-situ gesture;

producing a first motor input control signal causing said first motor behavior to result in said primary motor;

receiving a second multiple-frequency electrode return signal;

recognizing a second in-situ gesture in response to said second multiple-frequency electrode return signal;

determining a second motor behavior associated with said second in-situ gesture; and producing a second motor input control signal causing said second motor response to result;

wherein said first motor behavior associated with said first in-situ gesture and thereby resulting in said primary motor is one of:

an encircle far gesture associated with a light motor pattern resulting in said primary motor;

an encircle drag toward gesture associated with increasing the average amplitude in said primary motor;

an encircle near gesture associated with a heavy motor pattern resulting in said primary motor;

an encircle drag away gesture associated with decreasing the average amplitude in said primary motor;

a double encircle far gesture associated with a motor pattern in said primary motor heavier than a motor pattern associated with the encircle far gesture;

a double encircle drag toward gesture associated with increasing the average amplitude resulting in said primary motor;

a split encircle drag toward gesture associated with increasing the average amplitude of a motor;

a double encircle near gesture associated with a motor pattern heavier than the motor pattern of encircle near;

a double encircle drag away gesture associated with decreasing the average amplitude of a motor; and a split encircle drag away gesture associated with decreasing the average amplitude of a motor.

9. The apparatus of claim 8, wherein said control circuit is also configured to receive a second multiple-frequency electrode return signal, and to produce a second motor input control signal in response;

wherein said first electrode is configured to conduct said second multiple-frequency electrode return signal in response to a second in-situ gesture;

the apparatus further comprising a secondary motor having a second motor behavior, wherein the second motor behavior varies in response to said second motor input control signal, said primary motor being a forward motor and said secondary motor being a rearward motor; and wherein said second motor behavior associated with said second in-situ gesture and thereby resulting due to the outputting of said second motor input control is one of:

an encircle far gesture associated with varying the average amplitude of said forward motor;

an encircle drag toward gesture associated with rearward motor panning;

an encircle drag away gesture associated with forward motor panning;

a double encircle drag toward gesture associated with rearward motor panning;

a split encircle gesture associated with setting a forward and rearward motor to the same motor pattern;

a split encircle drag toward gesture associated with rearward motor panning;

a split encircle drag toward gesture associated with a motor pattern in a rearward motor that is heavier than a motor pattern in a rearward motor associated with encircle drag toward;

a double encircle drag away gesture associated with forward motor panning;

a split encircle drag away gesture associated with forward motor panning.

10. The apparatus of claim 8, further comprising:

an auxiliary sensor other than said first electrode, connected to said control circuit by an auxiliary lead, that produces a third sensor output control signal in response to a third in-situ gesture, said auxiliary sensor having an auxiliary sensor lengthwise axis, said auxiliary sensor being disposed such that the auxiliary sensor lengthwise axis is parallel to the internal extremity proximo-distal axis or is parallel to the external extremity proximo-distal axis;

said auxiliary sensor being taken from the group comprising:

a bend sensor;

a stretch sensor; and a clench sensor other than an electrode;

the non-transitory computer-readable medium storing additional computer-executable instructions causing the control circuit to perform the steps of:

determining a third motor behavior associated with said third in-situ gesture, said third motor behavior having an average period; and producing a third motor input control signal causing a third motor behavior to result in said primary motor, said third motor behavior resulting simultaneously with said first motor behavior;

wherein said third motor behavior associated with said third in-situ gesture and thereby resulting in said primary motor is at least one of:

an increase bend gesture associated with increasing the average amplitude of said primary motor;

an increase bend gesture associated with increasing the average period of said third motor behavior:

a decrease bend gesture associated with decreasing the average amplitude of said primary motor;

a decrease bend gesture associated with decreasing the average period of said third motor behavior:

a lengthwise stretch gesture associated with increasing the average amplitude of said primary motor;

a lengthwise stretch gesture associated with increasing the average period of said third motor behavior:

a lengthwise compress gesture associated with increasing the average amplitude of said primary motor;

a lengthwise compress gesture associated with increasing the average period of said third motor behavior:

a lateral clench gesture associated with increasing the average amplitude of said primary motor; and, a lateral clench gesture associated with increasing the average period of said third motor behavior.

11. The apparatus of claim 10, the apparatus further comprising a secondary motor having a second motor behavior, said primary motor being a forward motor and said secondary motor being a rearward motor wherein said third motor behavior occurs in said forward motor if the first in-situ gesture is one of: an encircle far gesture, or else a double encircle far gesture;

wherein said third motor behavior occurs in said rearward motor if the first in-situ gesture is one of: an encircle near gesture or else a double encircle near gesture;

and wherein said third motor behavior occurs in both said forward motor and said rearward motor if the first in-situ gesture is: a split encircle gesture.

12. The apparatus of claim 6, further comprising an auxiliary sensor, other than said first electrode, that produces a third sensor output control signal in response to a third in-situ gesture, said auxiliary sensor having a proximal end contiguous to said middle portion, a distal end being the tip of the auxiliary sensor furthest from said middle portion and an auxiliary sensor lengthwise axis, said auxiliary sensor being operatively connected to said control circuit by a second lead, said auxiliary sensor being disposed such that the auxiliary sensor lengthwise axis is parallel to the internal extremity proximo-distal axis or is parallel to the external extremity proximo-distal axis;

said auxiliary sensor being taken from the group comprising:

a bend sensor;

a stretch sensor; and a clench sensor other than an electrode.

13. The apparatus of claim 6, said flexible material or said first electrode comprising at least one of conductive fluorosilicone and conductive graphite powder.

14. An apparatus comprising:

a housing of flexible material, said housing comprising:

an external extremity having a tip, an internal extremity having a tip, and a middle portion, said external extremity having a dorsal side and a ventral side, said external extremity having a dorsal curve when at rest, said external extremity having a proximal end contiguous to said middle portion, a distal end being the tip of the external extremity furthest from said middle portion and an external extremity proximo-distal axis being a curved axis extending through the external extremity from its proximal end to its distal end, said internal extremity having a proximal end contiguous to said middle portion, a distal end being the tip of the internal extremity furthest from said middle portion and an internal extremity proximo-distal axis extending through the internal extremity from its proximal end to its distal end, said internal extremity and external extremity being disposed such that a lengthwise axis runs from the distal tip of the internal extremity, through the proximo-distal axis of the internal extremity, through the middle portion of the apparatus housing, through the proximo-distal axis of the external extremity, to the distal tip of the external extremity;

a control circuit configured to generate a first electrode output signal, receive a first electrode return signal, and to produce a first motor input control signal in response;

a first electrode, connected to said control circuit by a first lead, configured to conduct said first electrode output signal, and to conduct said first electrode return signal in response to a first in-situ gesture, said first electrode being disposed on or within the flexible material of one said extremity; and a primary motor having a behavior and having an average amplitude, wherein the behavior of said primary motor varies in response to said first motor input control signal, wherein said apparatus is a sex toy.

15. The apparatus of claim 14, wherein said first in-situ gesture is taken from the group consisting of: encircle far, encircle drag toward, encircle near, encircle drag away, double encircle far, double encircle drag toward, split encircle, split encircle drag toward, double encircle near, double encircle drag away, split encircle drag away.

16. The apparatus of claim 14, further comprising:

a non-transitory computer-readable medium that stores computer-executable instructions causing the control circuit to perform the steps of:

receiving said first electrode return signal;

recognizing said first in-situ gesture in response to which said first electrode return signal was produced;

determining a first motor behavior associated with said first in-situ gesture;

producing a first motor input control signal causing said first motor behavior to result in said primary motor;

receiving a second electrode return signal;

recognizing a second in-situ gesture in response to said second electrode return signal;

determining a second motor behavior associated with said second in-situ gesture; and producing a second motor input control signal causing said second motor response to result;

wherein said first motor behavior associated with said first in-situ gesture and thereby resulting in said primary motor is one of:

an encircle far gesture associated with a light motor pattern resulting in said primary motor;

an encircle drag toward gesture associated with increasing the average amplitude in said primary motor;

an encircle near gesture associated with a heavy motor pattern resulting in said primary motor;

an encircle drag away gesture associated with decreasing the average amplitude in said primary motor;

a double encircle far gesture associated with a motor pattern heavier than the motor pattern associated with the encircle far gesture to result resulting in said primary motor;

a double encircle drag toward gesture associated with increasing the average amplitude in said primary motor;

a split encircle drag toward gesture associated with increasing the average amplitude in said primary motor;

a double encircle near gesture associated with causing a motor pattern heavier than the motor pattern of encircle near to result in said primary motor;

a double encircle drag away gesture associated with decreasing the average amplitude in said primary motor; and a split encircle drag away gesture associated with decreasing the average amplitude in said primary motor.

17. The apparatus of claim 16, wherein said control circuit is also configured to receive a second electrode return signal, and to produce a second motor input control signal in response;

wherein said first electrode is configured to conduct said second electrode return signal in response to a second in-situ gesture;

the apparatus further comprising a secondary motor having a second motor behavior, wherein the second motor behavior varies in response to said second motor input control signal, said primary motor being a forward motor and said secondary motor being a rearward motor; and wherein said second motor behavior associated with said second in-situ gesture and thereby resulting due to the outputting of said second motor input control is one of:

an encircle drag toward gesture associated with rearward motor panning;

an encircle drag away gesture associated with forward motor panning;

a double encircle drag toward gesture associated with rearward motor panning;

a split encircle gesture associated with setting a forward and rearward motor to the same motor pattern;

a split encircle drag toward gesture associated with rearward motor panning;

a split encircle drag toward gesture associated with a motor pattern in a rearward motor that is heavier than a motor pattern in a rearward motor associated with encircle drag toward;

a double encircle drag away gesture associated with forward motor panning; or a split encircle drag away gesture associated with forward motor panning.

18. The apparatus of claim 16, further comprising:

an auxiliary sensor other than said first electrode, connected to said control circuit by an auxiliary lead, that produces a third sensor output control signal in response to a third in-situ gesture, said auxiliary sensor having an auxiliary sensor lengthwise axis, said second sensor being disposed such that the auxiliary sensor lengthwise axis is parallel to the internal extremity proximo-distal axis or is parallel to the external extremity proximo-distal axis;

said auxiliary sensor being taken from the group comprising:

a bend sensor;

a stretch sensor; and a clench sensor other than an electrode;

the non-transitory computer-readable medium storing additional computer-executable instructions causing the control circuit to perform the the steps of:

determining a third motor behavior associated with said third in-situ gesture, said third motor behavior having an average period; and producing a third motor input control signal causing a third motor behavior to result in said primary motor, said third motor behavior resulting simultaneously with said first motor behavior;

wherein said third motor behavior associated with said third in-situ gesture and thereby resulting in said primary motor is at least one of:

an increase bend gesture associated with increasing the average amplitude of said primary motor;

an increase bend gesture associated with increasing the average period of said primary motor;

a decrease bend gesture associated with decreasing the average amplitude of said primary motor;

a decrease bend gesture associated with decreasing the average period of said primary motor;

a lengthwise stretch gesture associated with increasing the average amplitude of said primary motor;

a lengthwise stretch gesture associated with increasing average period of said primary motor;

a lengthwise compress gesture associated with increasing the average amplitude of said primary motor;

a lengthwise compress gesture associated with increasing the average period of said primary motor;

a lateral clench gesture associated with increasing the average amplitude of said primary motor; and, a lateral clench gesture associated with increasing the average period of said primary motor.

19. The apparatus of claim 18, the apparatus further comprising a secondary motor having a second motor behavior, said primary motor being a forward motor and said secondary motor being a rearward motor, wherein said third motor behavior occurs in said forward motor if the first in-situ gesture is one of: an encircle far gesture, or else a double encircle far gesture;

wherein said third motor behavior occurs in said rearward motor if the first in-situ gesture is one of: an encircle near gesture, or else a double encircle near gesture;

and wherein said third motor behavior occurs in both said forward motor and said rearward motor if the first in-situ gesture is: a split encircle gesture.

20. The apparatus of claim 14, further comprising an auxiliary sensor other than said first electrode that produces a third sensor output control signal in response to a third in-situ gesture, said auxiliary sensor having a proximal end contiguous to said middle portion, a distal end being the tip of the auxiliary sensor furthest from said middle portion and an auxiliary sensor lengthwise axis, said auxiliary sensor being operatively connected to said control circuit by an auxiliary lead running from the proximal end of the auxiliary sensor to the control circuit, said auxiliary sensor being disposed such that the auxiliary sensor lengthwise axis is parallel to the internal extremity proximo-distal axis or is parallel to the external extremity proximo-distal axis;

said auxiliary sensor being taken from the group comprising:

a bend sensor;

a stretch sensor; and a clench sensor other than an electrode.

* * * * *